US011242779B1

(12) United States Patent
Vant Hoff et al.

(10) Patent No.: US 11,242,779 B1
(45) Date of Patent: Feb. 8, 2022

(54) ENGINE LUBRICATION SYSTEM

(71) Applicant: Kohler Co., Kohler, WI (US)

(72) Inventors: Timothy Arlyn Vant Hoff, Campbellsport, WI (US); Benjamin Joseph Bink, St. Cloud, WI (US); Sean Allen Rusch, Cedarbur, WI (US)

(73) Assignee: Kohler Co.

( * ) Notice: Subject to any disclaimer, the term of this patent is extended or adjusted under 35 U.S.C. 154(b) by 0 days.

(21) Appl. No.: 17/070,624

(22) Filed: Oct. 14, 2020

(51) Int. Cl.
*F01M 11/00* (2006.01)
*F01M 1/02* (2006.01)
*F02F 7/00* (2006.01)

(52) U.S. Cl.
CPC ..... *F01M 11/0004* (2013.01); *F01M 1/02* (2013.01); *F01M 2011/0033* (2013.01); *F01M 2011/0087* (2013.01); *F02F 7/00* (2013.01)

(58) Field of Classification Search
CPC ..... F01M 11/0004; F01M 1/02; F01M 2011/0033; F01M 2011/0087; F01M 2011/005; F01M 2011/007; F02F 7/00
See application file for complete search history.

(56) References Cited

U.S. PATENT DOCUMENTS 5,937,817 A * 8/1999 Schanz ..... F01M 11/0004 123/196 AB
8,397,750 B2 * 3/2013 Fujita ..... F16N 31/002 137/574
8,578,906 B2 * 11/2013 Yamada ..... F01M 11/064 123/196 R
10,865,671 B2 * 12/2020 Shieh ..... F01M 11/0004

OTHER PUBLICATIONS https://cdn.shopify.com/s/files/1/1034/8027/files/Oil_Pan_1_piece_Cast.pdf?5580280392957012196.
https://cdn.shopify.com/s/files/1/1034/8027/files/2-29-08-plus_one_oil_pan_instructions-2-piece.pdf?10032833762976000444.
https://cdn.shopify.com/s/files/1/1034/8027/files/BAKER_1.5_Instructions_V5-090716.pdf?4351050410334260192.

* cited by examiner

*Primary Examiner* — Syed O Hasan
(74) *Attorney, Agent, or Firm* — The Belles Group, P.C.

(57) ABSTRACT

An engine oil lubrication system includes an oil flow control baffle disposed in the sump of the oil pan. The baffle may be detachably mountable in the sump of the oil pan. The baffle may be configured to prevent oil returning to the sump from the engine from short-circuiting and flowing directly to the oil pump intake. The baffle creates a circuitous flow path which forces mixing of the returning oil before being drawn into the oil pump intake nozzle via increasing resonance time of the oil in the sump to enhance cooling. The present disclosure further provides a modular engine mounting system which extends the number of engines and vehicle chassis which can utilize a single oil pan to mount to the chassis. Interchangeable mounting flanges are provided having different bolting patterns compatible with the different chassis.

23 Claims, 40 Drawing Sheets

ENGINE LUBRICATION SYSTEM

BACKGROUND

The present invention generally relates to internal combustion engines, and more particularly to oil lubrication systems and related devices or apparatuses for such engines.

Internal combustion engines utilize oil for lubricating moving parts. The lubrication system may comprise an oil pan coupled to the crankcase of the engine. The pan provides a sump or reservoir for collecting the oil. In operation, an oil pump takes suction from the reservoir and distributes the oil to various moving engine parts requiring lubrication to reduce friction and metal-to-metal wear. The oil returns to the oil pan reservoir from the engine to complete the oil flow loop and repeat the lubrication cycle again. The high operating temperature of the engine heats the oil as it lubricates the moving components. It is beneficial to cool the oil in the oil pan reservoir before it is pumped back to the engine to maximize the lubrication qualities of the oil and minimize engine component wear as well as extend the useful life of the oil before replacement is needed.

The oil pan may further be used as an intermediate engine mounting component or interface for rigidly mounting the engine to the chassis or frame of the vehicle typically via bolting. The oil pans may have bolting holes to accommodate engine mounting. Various chassis, however, require different mounting interfaces each having a unique bolting pattern which are not compatible with the bolt pattern already provided by a particular oil pan. Accordingly, numerous styles of oil pans having customized engine mounting bolt patterns suited for a single or particular chassis are typically required. This limits the adaptability of using a single style of oil pan for many different chassis mounting requirement, which unavoidably increases manufacturing costs to provide multiple oil pans each with specialized engine mounting bolt pattern to suit different chassis.

Improvements are desired to better distribute and control the flow of oil in the oil pan to maximize cooling. Improvements are also desired to provide greater flexibility for mounting an oil pan to a number of different engines each having different oil pan mounting interfaces.

SUMMARY

The present application discloses an engine oil lubrication system which optimizes cooling of the oil through improved flow control and mixing of return oil in the oil sump. The engine oil lubrication system may include an oil flow control baffle disposed in the reservoir or sump of the oil pan. The baffle may be detachably mountable to the bottom wall of an oil pan in one implementation. The baffle may be configured to prevent oil returning to the sump from the engine from short-circuiting and flowing directly to the oil pump intake. The baffle creates a circuitous flow path which forces mixing of the returning oil before being sucked into the oil pump intake nozzle in the sum, thereby advantageously enhancing oil cooling. By increasing both mixing and the resonance time of the oil in the sump, an opportunity to maximize oil cooling can be realized in the oil pan.

In some implementations, the flow control baffle may have a hood-shaped body configured to define an internal cavity and plurality of oil inlet openings. The body may include a top wall, sidewalls, and an open bottom. The inlet openings, which may be formed in the sidewalls, establish fluid communication between the cavity and a peripheral oil collection region of the sump surrounding and circumscribing the exterior of the baffle. An oil pump intake opening may be formed through the baffle which communicates with the internal cavity. The oil pick-up or intake nozzle (e.g. snorkel) of the oil pump passes through the intake opening into the cavity to withdraw oil beneath the baffle in the sump via suction. The intake nozzle may be integrally formed with the baffle in some designs as a unitary structural part thereof which eliminates the intake opening.

The flow control baffle may be made of any suitable non-metallic or metallic material which may be chemically compatible for handling oil and the heat of the engine without undue physical degradation. The material selected may further be corrosion resistant.

In some engine constructions, the oil lubrication system may not have a separable oil pan bolted to the crankcase of the engine. In such designs, the oil sump may be integrally formed as part of the engine crankcase casting at the bottom of the engine. A flow control baffle for these type engines may be a separate component mountable to the bottom wall of the crankcase in the integral oil sump via access through the engine before the engine is fully assembled and closed up.

In some implementations, the baffle may include an internal flow diversion labyrinth disposed within the cavity of the baffle to further enhance lubrication oil cooling. This adds to the circuitous flow pathway between the sump and oil pump intake nozzle, thereby increases resonance time and cooling of the oil in the sump prior to getting drawn into the oil pump intake nozzle inside the baffle.

According to another aspect, the present disclosure further provides an oil pan having a highly configurable and adaptable universal engine mounting system which interfaces with the vehicle chassis. This mounting system extends the number of engines and vehicle frames which can utilize a single oil pan which may include a plurality of modular mounting flanges each with different bolt patterns compatible with the chassis bolt pattern for completing the engine to chassis coupling.

In one aspect, an engine oil flow control system comprises: an oil sump; a flow control baffle disposed in the oil sump, the baffle including an internal cavity and a plurality of oil inlet openings leading into the cavity; a peripheral oil collection region formed in the sump and extending perimetrically around the baffle; an oil pump intake nozzle disposed at least partially in the cavity and fluidly coupled to an oil pump; wherein a return oil flow path is established between the oil collection region and the cavity via the oil inlet openings.

According to another aspect, a method for mounting a flow control baffle in an oil sump of an engine comprises: providing the baffle which comprises a hood-like body including an internal cavity and plurality of oil inlet openings in fluid communication with the cavity; coupling an oil intake nozzle at a first end of the baffle to an oil inlet port in a crankcase closure plate, the baffle supported by the crankcase closure plate; positioning the crankcase closure plate against a crankcase of the engine while simultaneously inserting the baffle into an oil sump of the crankcase; and securing the crankcase closure plate onto the crankcase which closes the oil sump.

According to another aspect, a modular mounting system for an engine comprises: an oil pan comprising a plurality of sidewalls which collectively define an oil sump configured to maintain an inventory of lubrication oil, the oil pan configured for detachable mounting to the engine; a first sidewall of the plurality of sidewalls comprising a plurality of bolt mounting bosses; an elongated first engine mounting flange detachably coupled to the mounting bosses of the first sidewall; the first engine mounting flange comprising a plurality of engine mounting holes arranged in a bolt pattern configured to match a corresponding bolt pattern of a vehicle chassis; wherein the engine is supported by the chassis via the first engine mounting flange.

According to another aspect, a method for mounting an engine to a vehicle chassis comprises: providing an oil pan and plurality of different engine mounting flanges including at least one first mounting flange and at least one second mounting flange, the first mounting flange having first engine mounting holes arranged in a first bolt pattern which is different than a second bolt pattern of second engine mounting holes in the second mounting flange; selecting the first mounting flange; detachably coupling the first mounting flange to a sidewall of the oil pan; and bolting the first mounting flanges to the vehicle chassis.

According to another aspect, an oil pan with air venting system for an engine comprises: a body configured for mounting to a crankcase of an engine, the body including a bottom wall, a top wall, and a plurality of sidewalls extending between the top and bottom walls which collectively form an oil sump; an engine mounting flange disposed on the top wall which defines a top opening of the oil pan, the mounting flange comprising a plurality of vertical walls which project partially downwards from the top wall of the oil pan into the oil sump; a dead space formed in peripheral portions of the oil sump beneath the top wall between the vertical walls of the engine mounting flange and the sidewalls; and a plurality of air vent holes extending through the vertical walls of the engine mounting flange and in fluid communication with the top opening of the oil pan; wherein the vent holes are operable to allow trapped air in the dead space to be forced out through the top opening into the crankcase of the engine when the oil pan is filled with oil.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein like elements are labeled similarly and in which.

Figure 1:
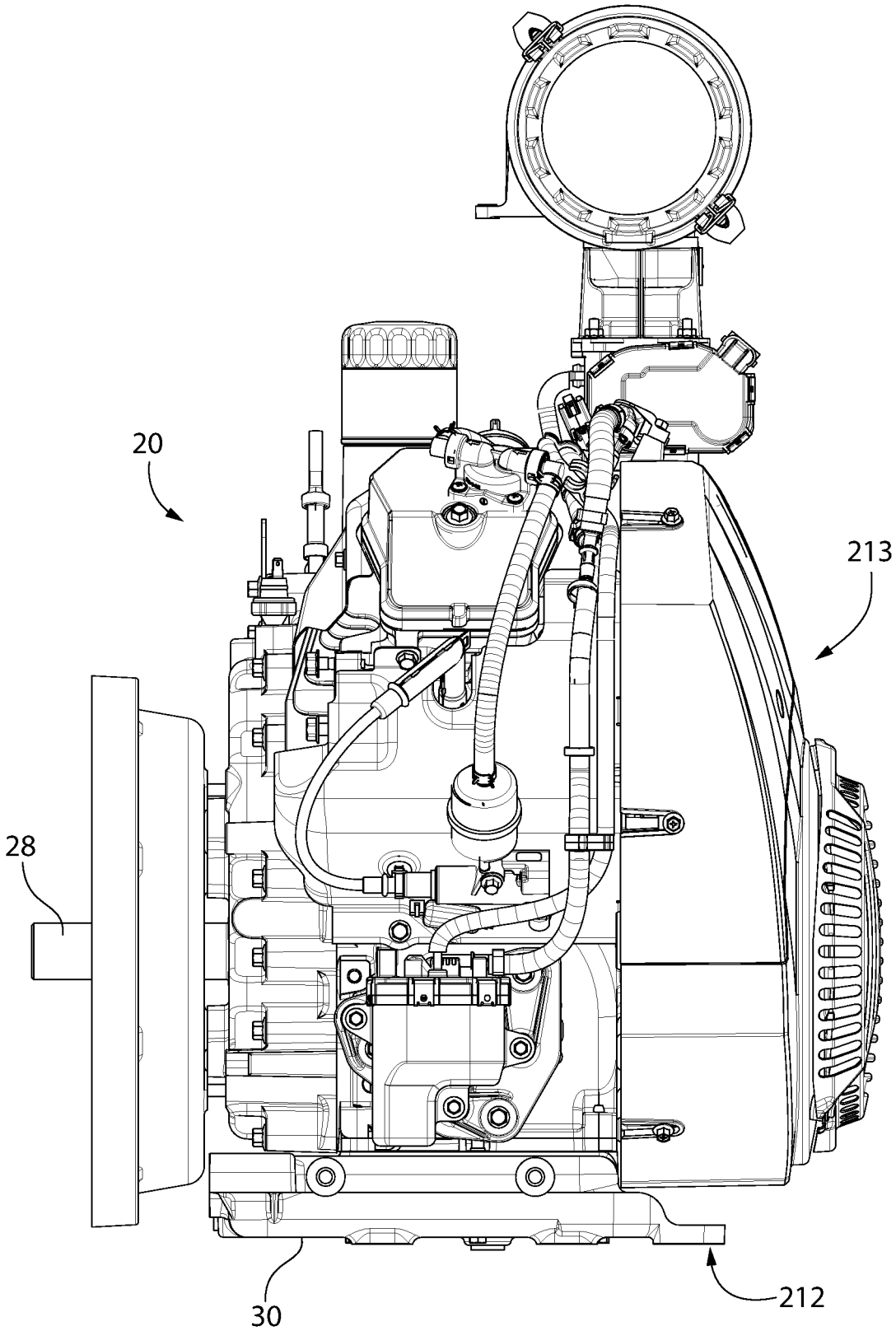
FIG. 1 is a side view of an engine including a first embodiment of an engine oil lubrication system with oil sump flow controls according to the present disclosure.
Figure 2:
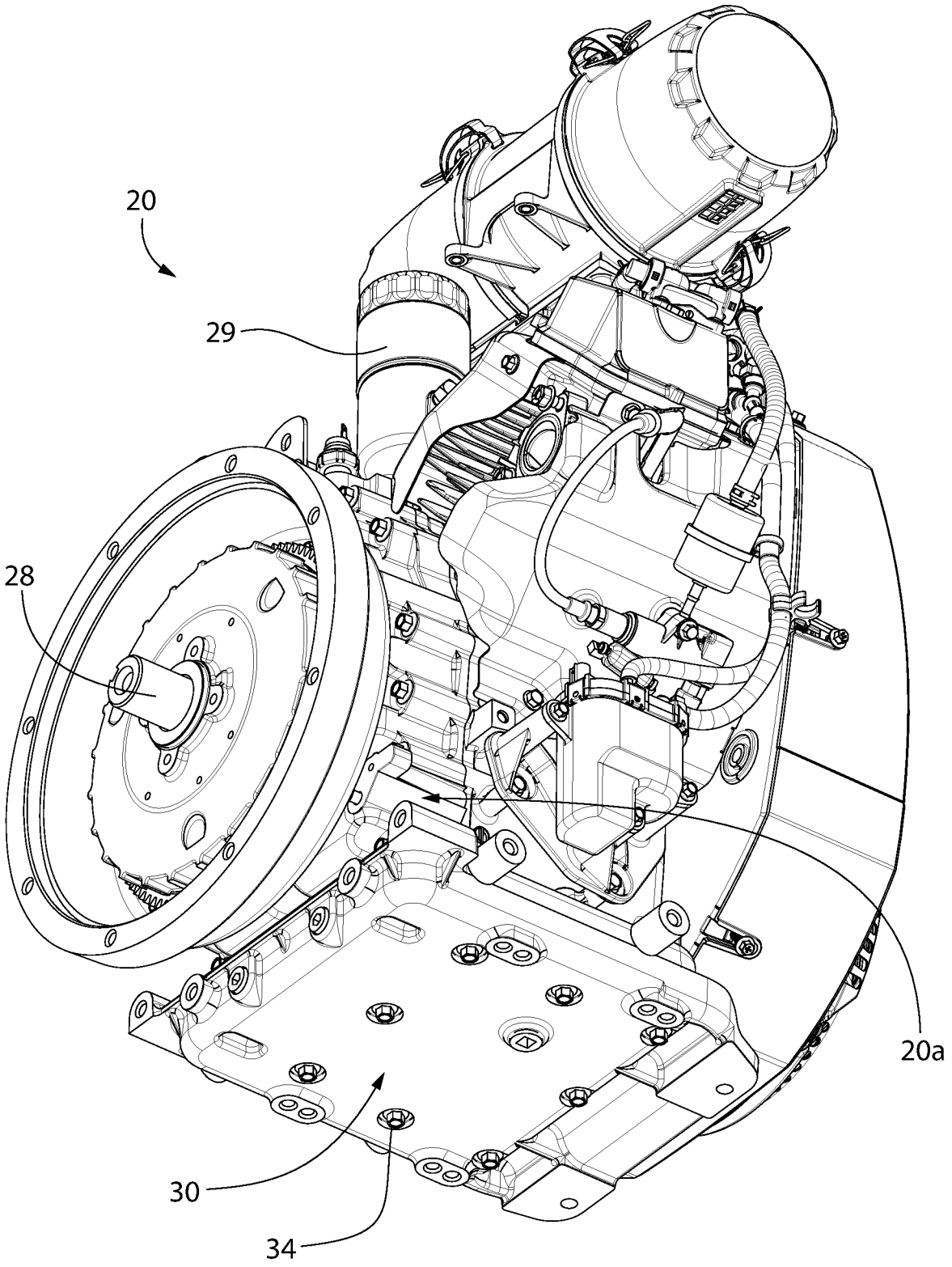
FIG. 2 is a bottom perspective view thereof.

All drawings are schematic and not necessarily to scale. Features shown numbered in certain figures which may appear un-numbered in other figures are the same features unless noted otherwise herein.

DETAILED DESCRIPTION

The features and benefits of the invention are illustrated and described herein by reference to non-limiting examples in which aspects of the disclosure may be embodied. This description of examples is intended to be read in connection with the accompanying drawings or photos, which are to be considered part of the entire written description. Accordingly, the disclosure expressly should not be limited to such examples illustrating some possible non-limiting combination of features that may exist alone or in other combinations of features disclosed herein.

In the description of examples disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

FIGS. 1-17 depict an internal combustion engine 20 with separable oil pan 30 including an oil lubrication system with flow control baffle 30 according to one implementation of the present disclosure.

Engine 20 may includes all the typical components of the drive system (e.g. crankshaft, pistons, flywheel, spark plugs, etc.), controls, electric system, air or water cooling system (e.g. water pump, blower, etc.), and oil lubrication system as will be well-known in the engine arts without further undue elaboration herein.

Figure 3:
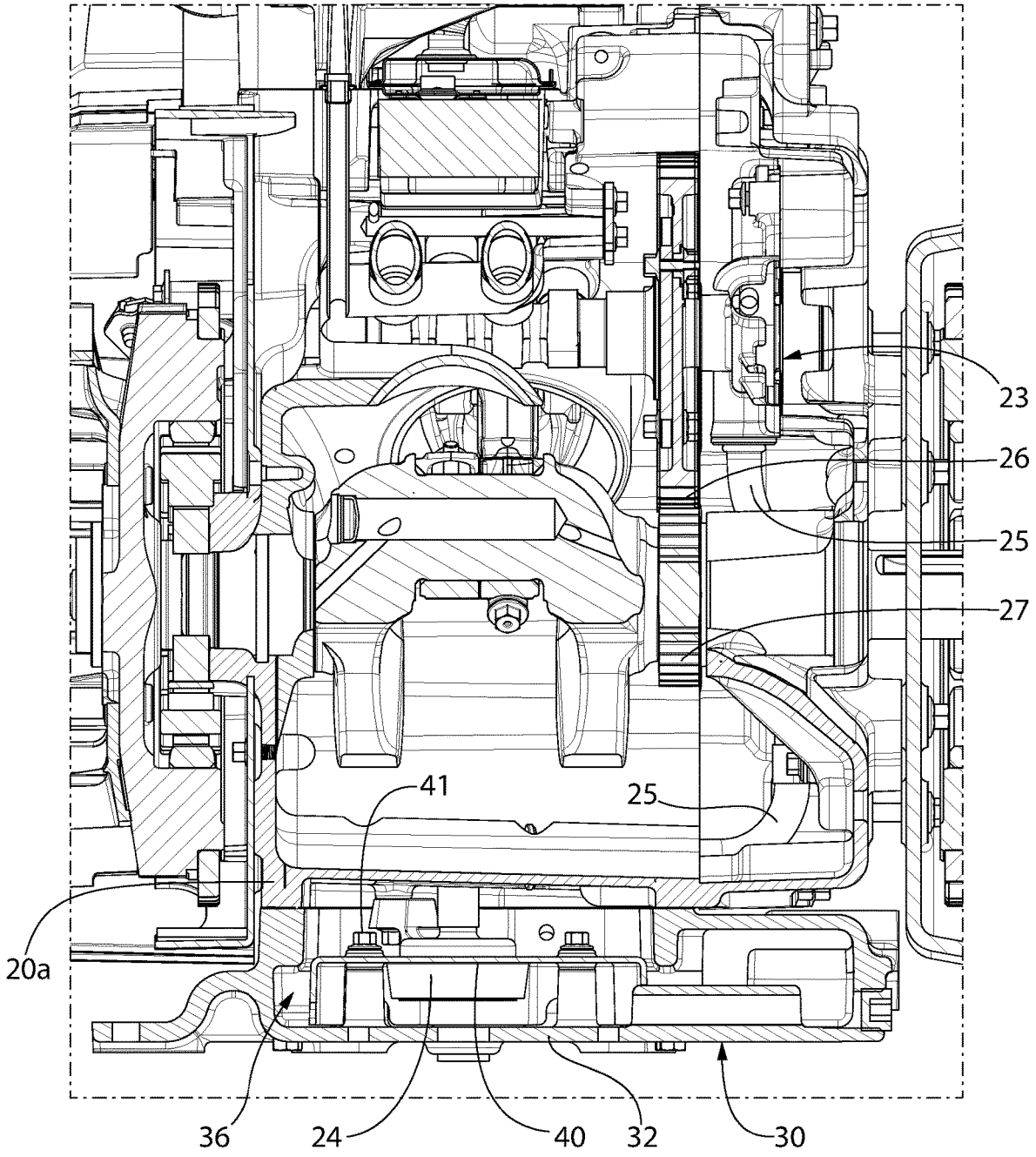
FIG. 3 is a side partial cross-sectional view of the crankcase portion of the engine with an oil pan according to the present disclosure.

The oil lubrication system may generally include oil pan 30, oil filter 29, oil pump 23 and associated oil intake nozzle 24 fluidly coupled to pump 23 by oil flow conduit 25 (see, e.g. FIG. 3). Conduit 25 may be flexible tubing or hosing in some implementations. Oil pump gear 26 is driven by drive gear 27 coupled to the rotating engine crankshaft 28 which operates pump 23 to lubricate the meshing metal components of the drive system typically requiring lubrication. Lubrication oil is pumped through oil filter 29 and is then distributed to the various components of the drive system to be lubricated. The return oil then drains back downwards via gravity to the oil pan 30 mounted to the bottom of engine crankcase 20*a* (see, e.g. FIGS. 5-6 and oil flow arrows), such as via bolting 34 or other methods. This completes the closed loop lubrication oil flow path.

Oil pan 30 may include a top wall 37, bottom wall 32, and a plurality of sidewalls 33 extending therebetween which collectively define an internal reservoir or sump 36. Oil sump 36 may be configured to maintain an inventory of lubrication oil 35 that establishes a level L of oil during operation of the engine as oil is withdrawn by oil pump 23 (see, e.g. FIG. 5—level may be different than that shown for illustrative purposes only). The longer the oil remains in the sump, the greater the opportunity for mixing and cooling the hotter incoming oil returned from the engine before being sucked up again by the oil pump 23. Oil may be periodically drained and replaced via oil plug 38 accessible on the bottom wall 32 (see, e.g. FIG. 10).

Figure 8:
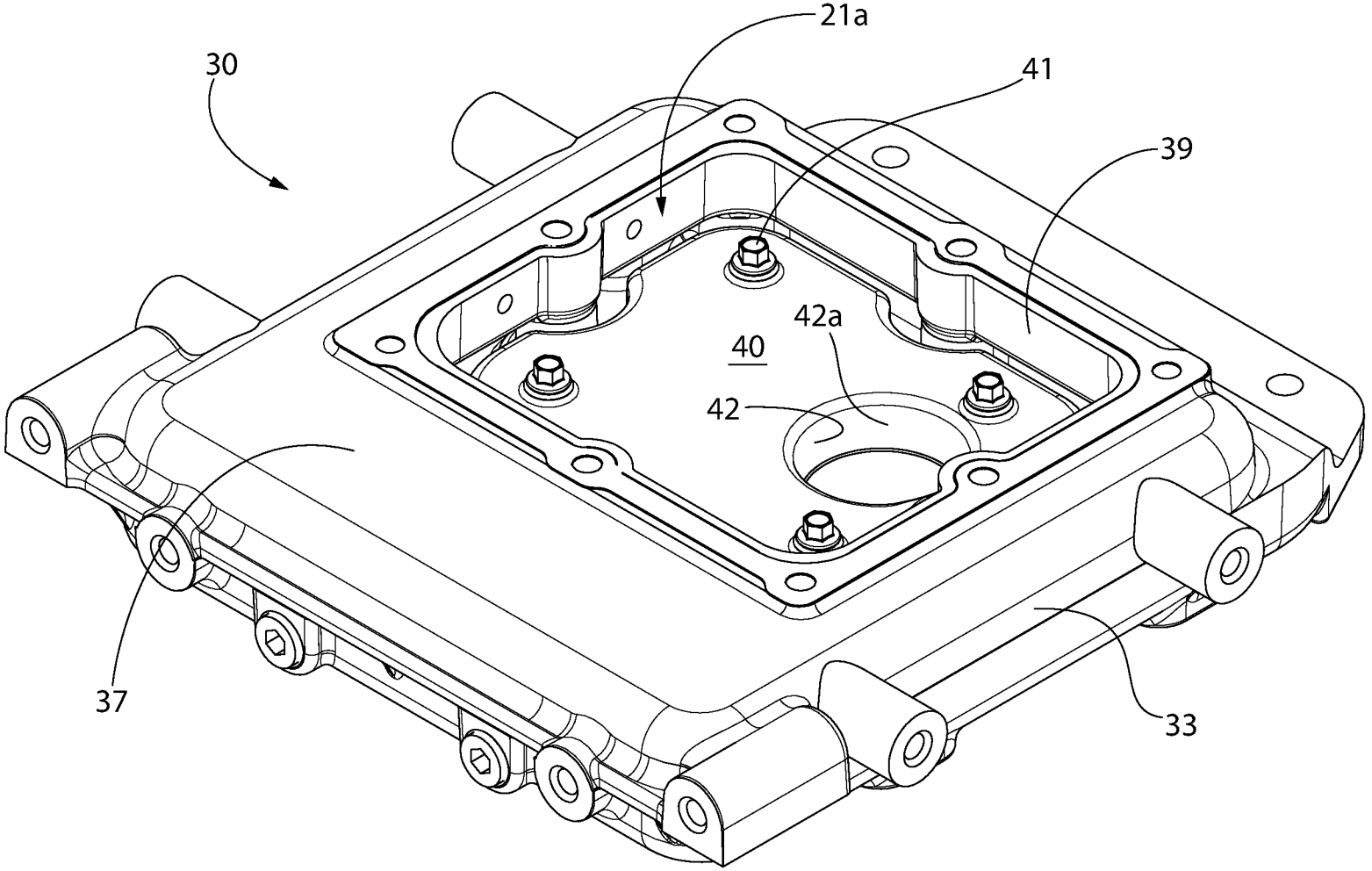
FIG. 8 is a first top perspective view thereof.
Figure 9:
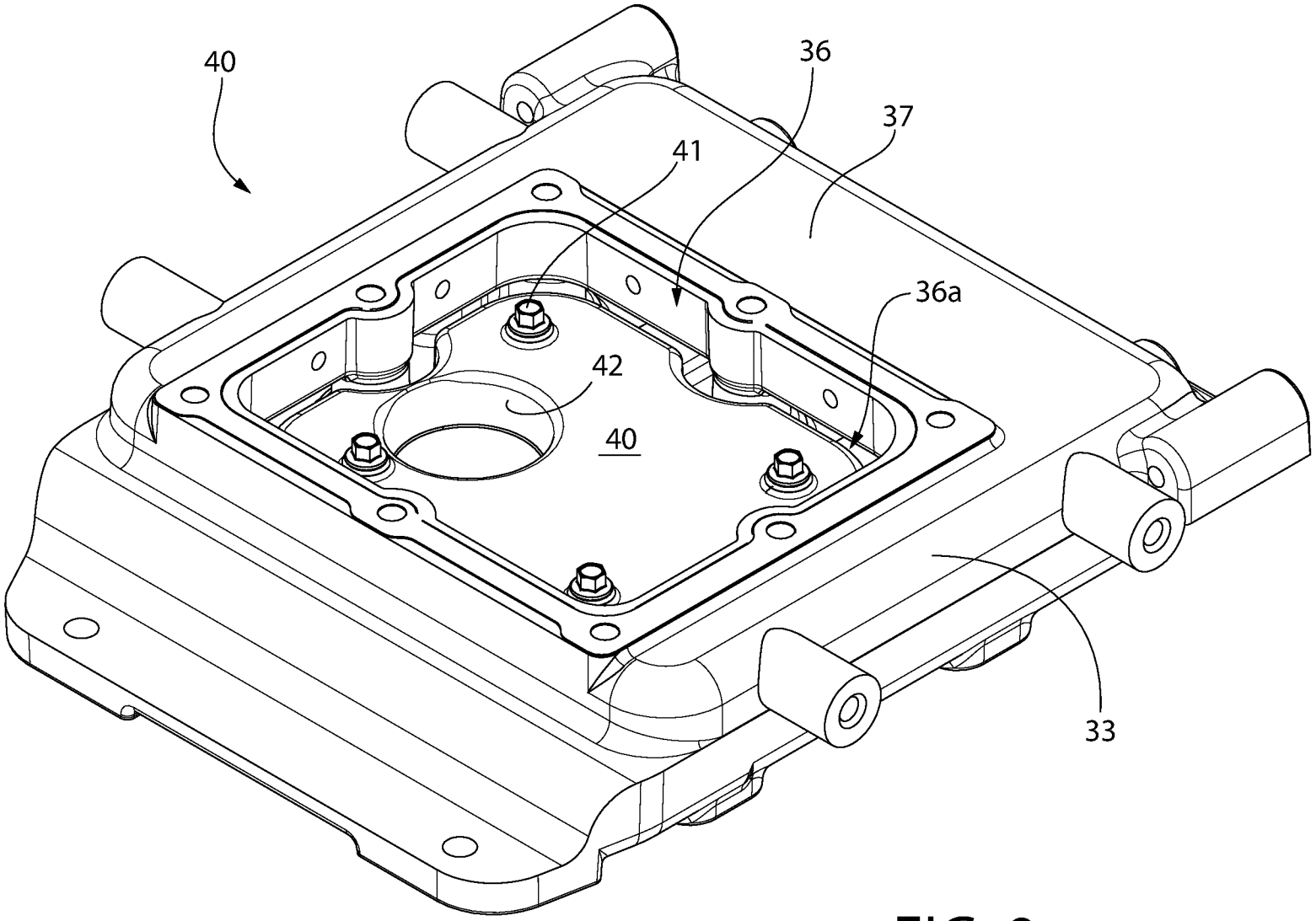
FIG. 9 is a second top perspective view thereof.
Figure 10:
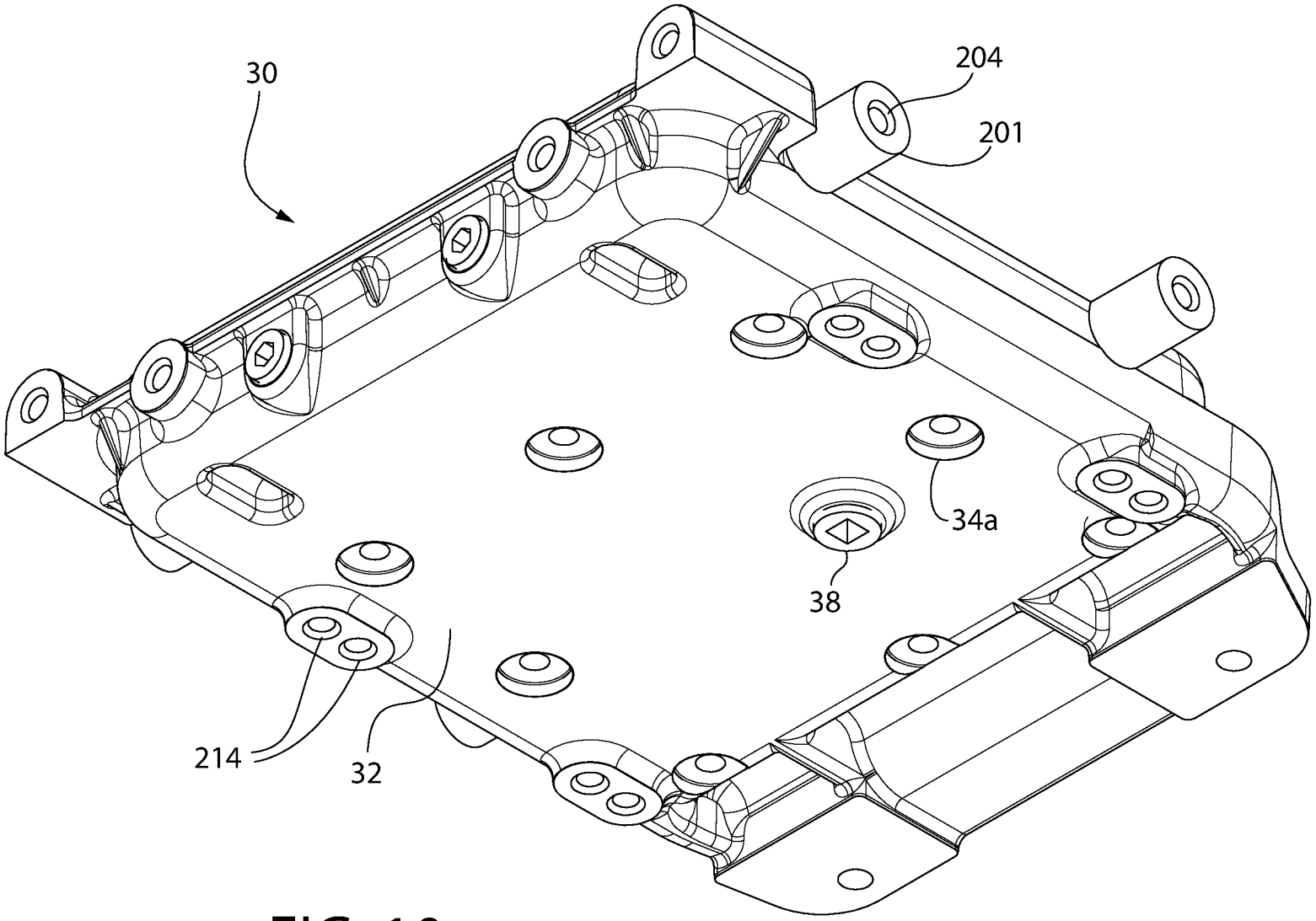
FIG. 10 is a bottom perspective view thereof.
Figure 11:
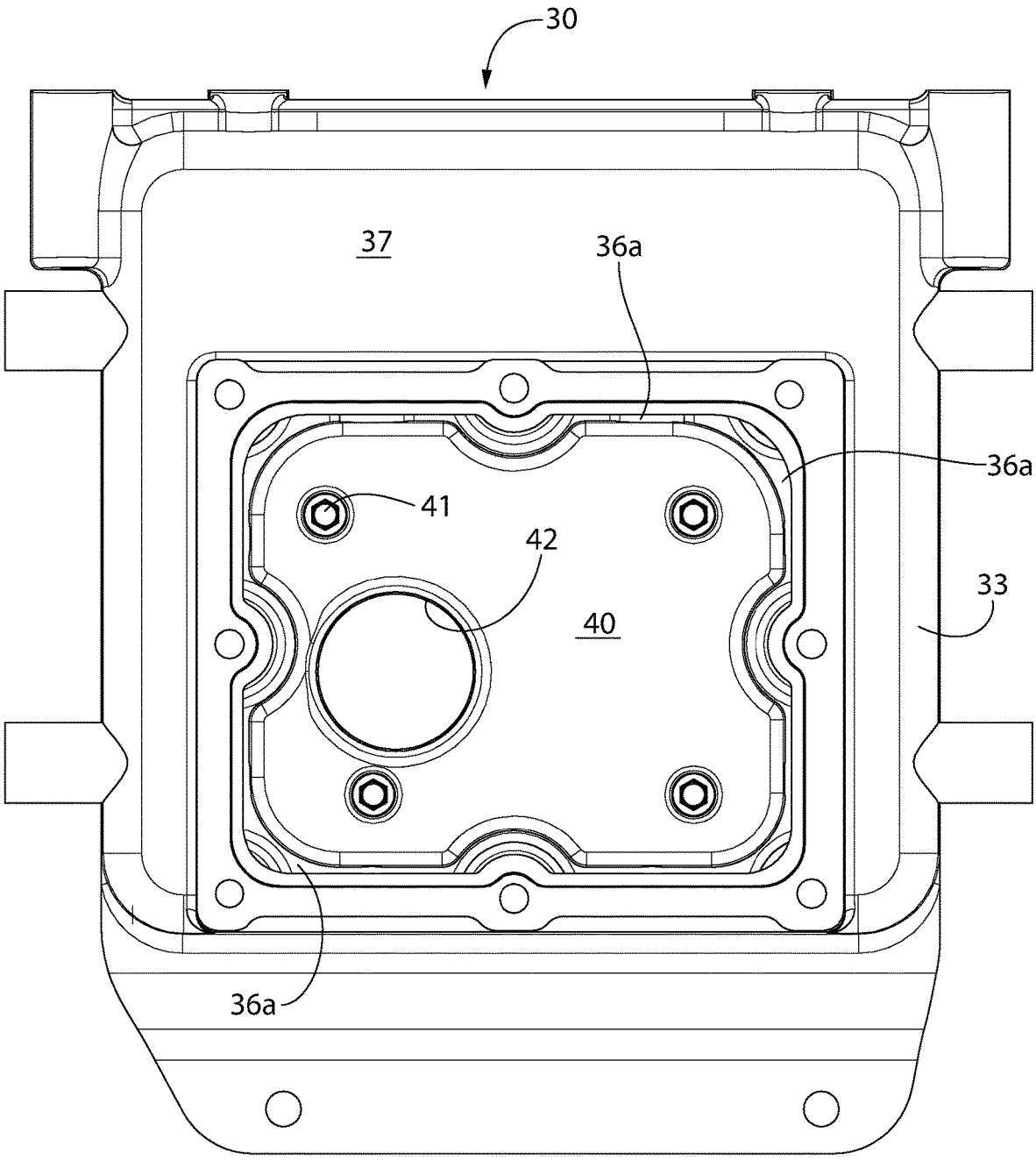
FIG. 11 is a top plan view thereof.
Figure 12:
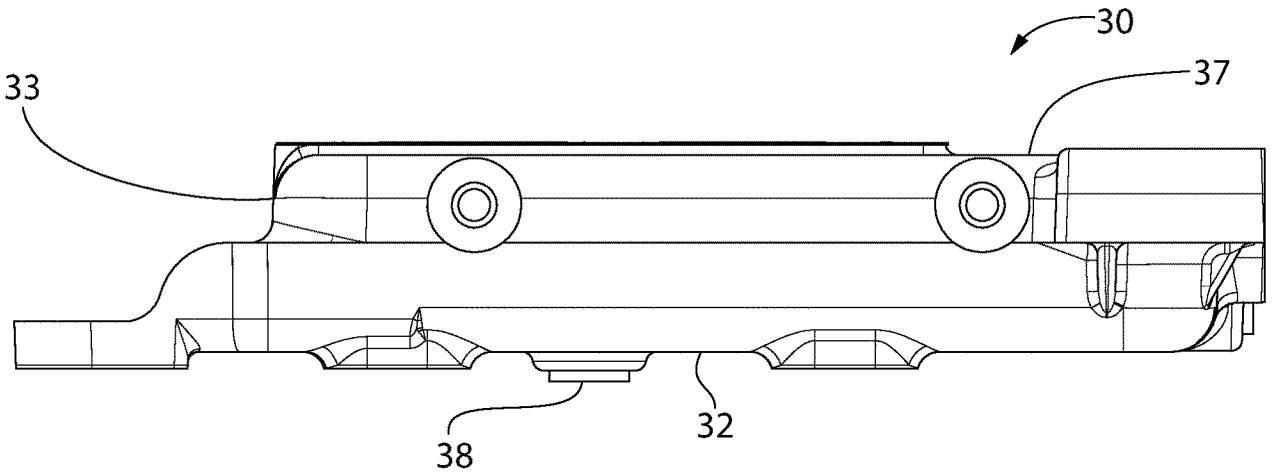
FIG. 12 is a first side view thereof.
Figure 13:
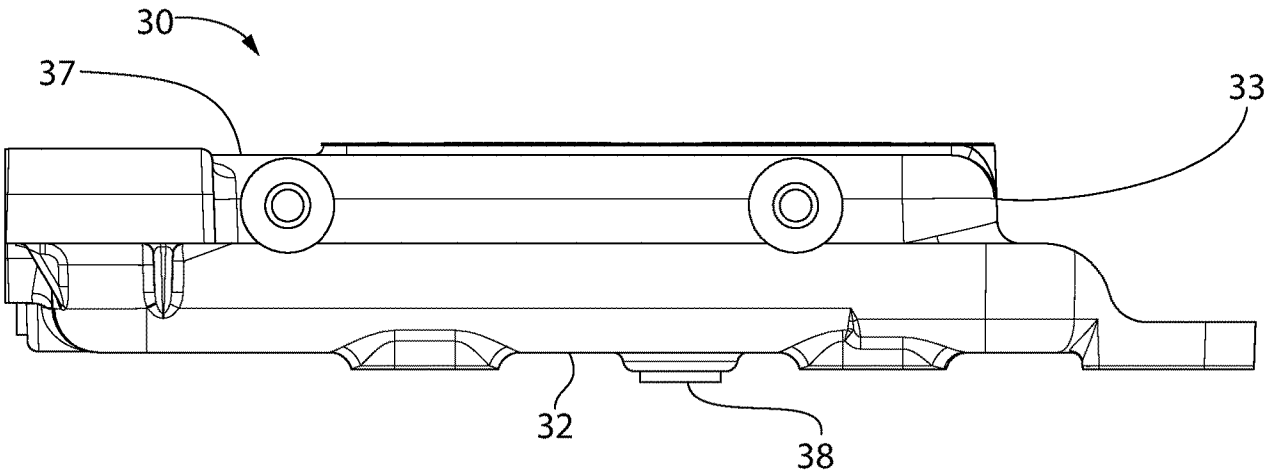
FIG. 13 is a second side view thereof.
Figure 14:
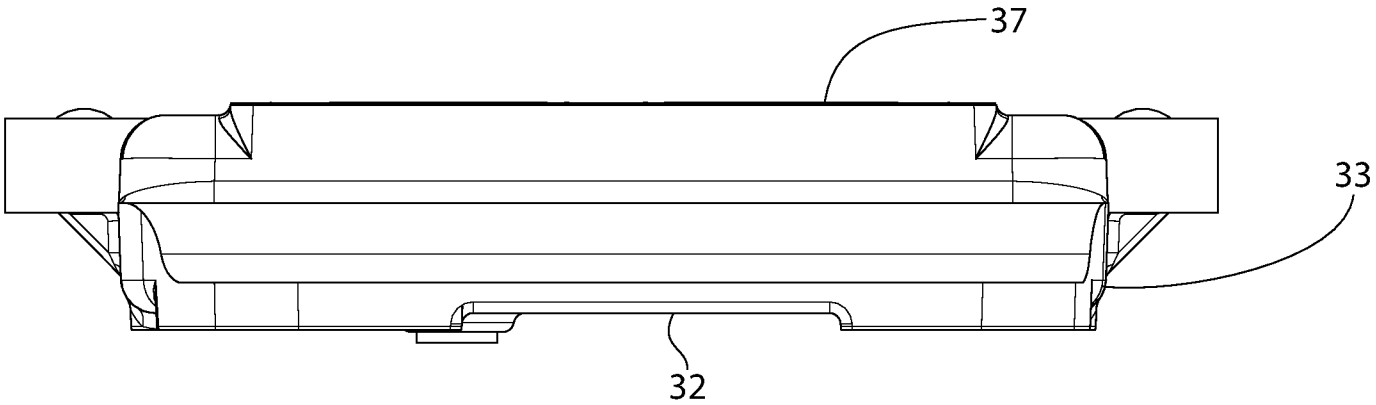
FIG. 14 is a third side view thereof.
Figure 15:
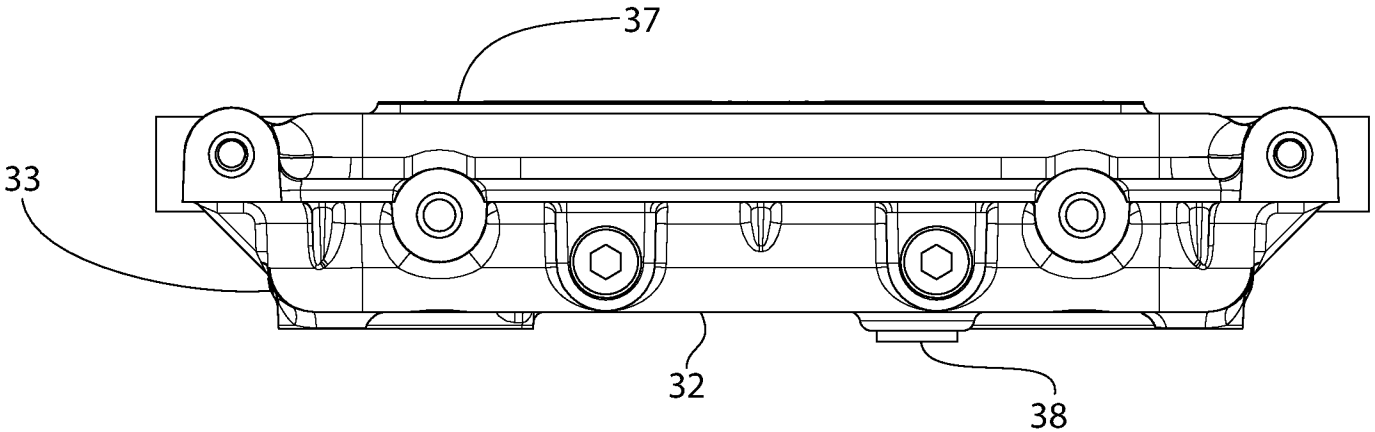
FIG. 15 is a fourth side view thereof.
Figure 16:
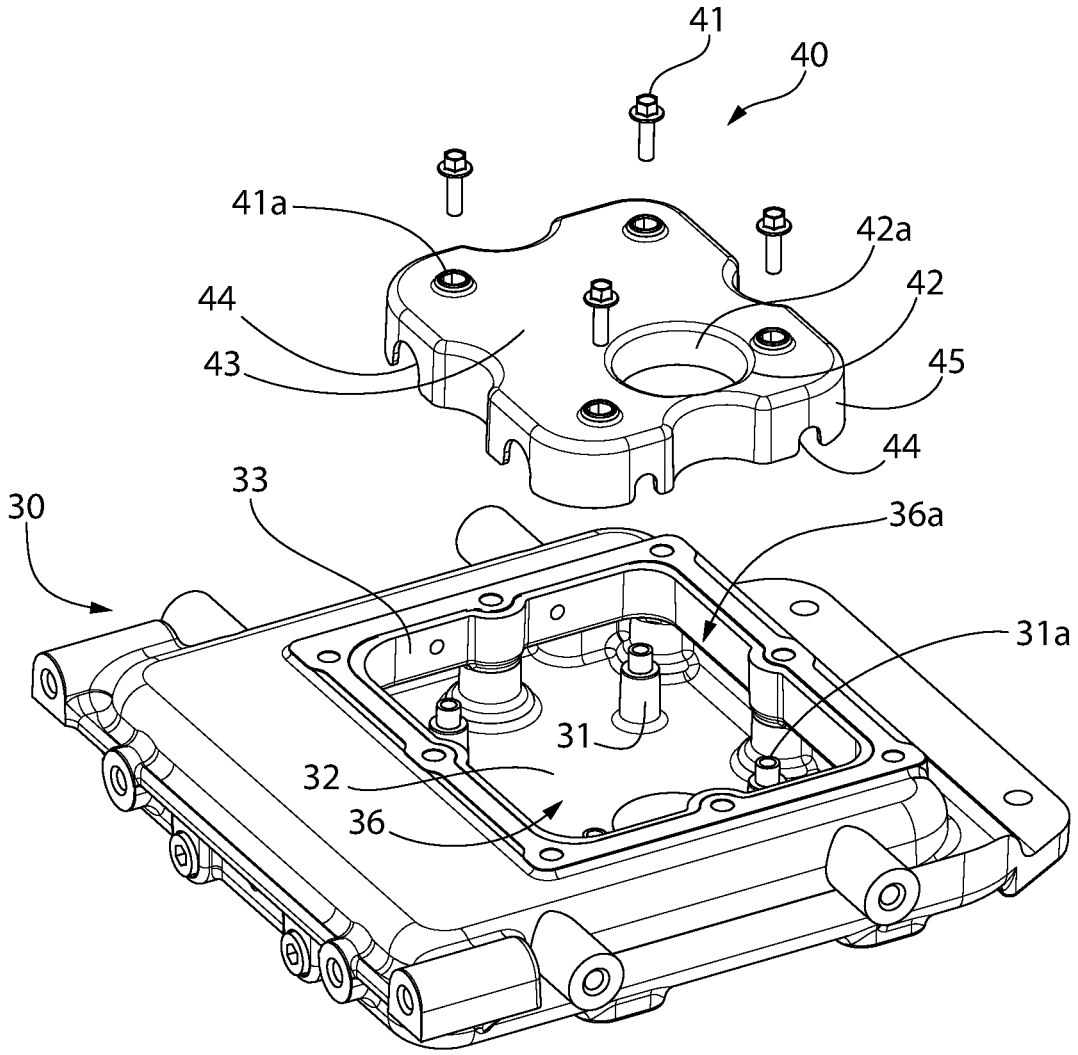
FIG. 16 is an exploded top perspective view thereof showing the flow control baffle removed from the oil pan.
Figure 17:
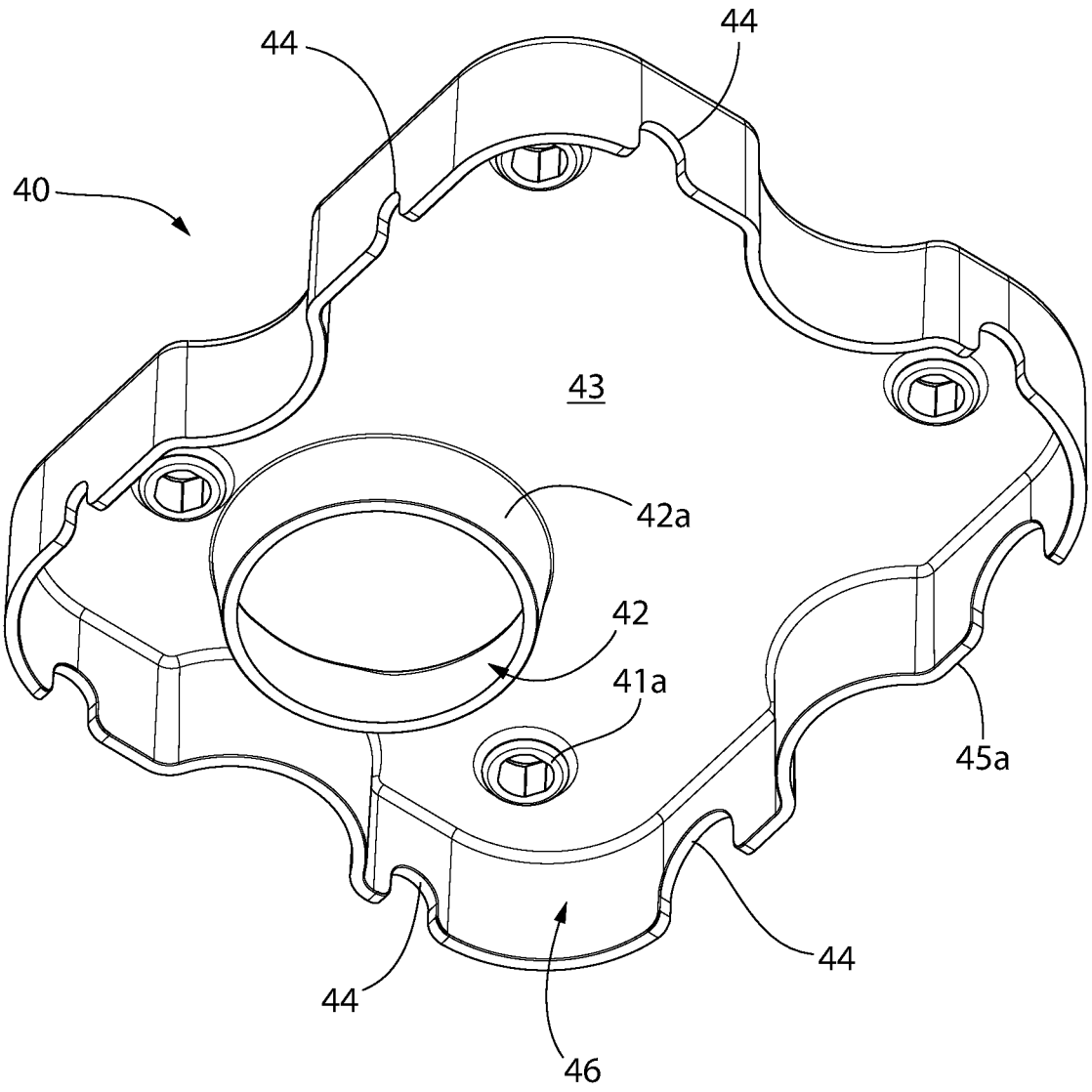
FIG. 17 is a bottom perspective view of the baffle.
Figure 18:
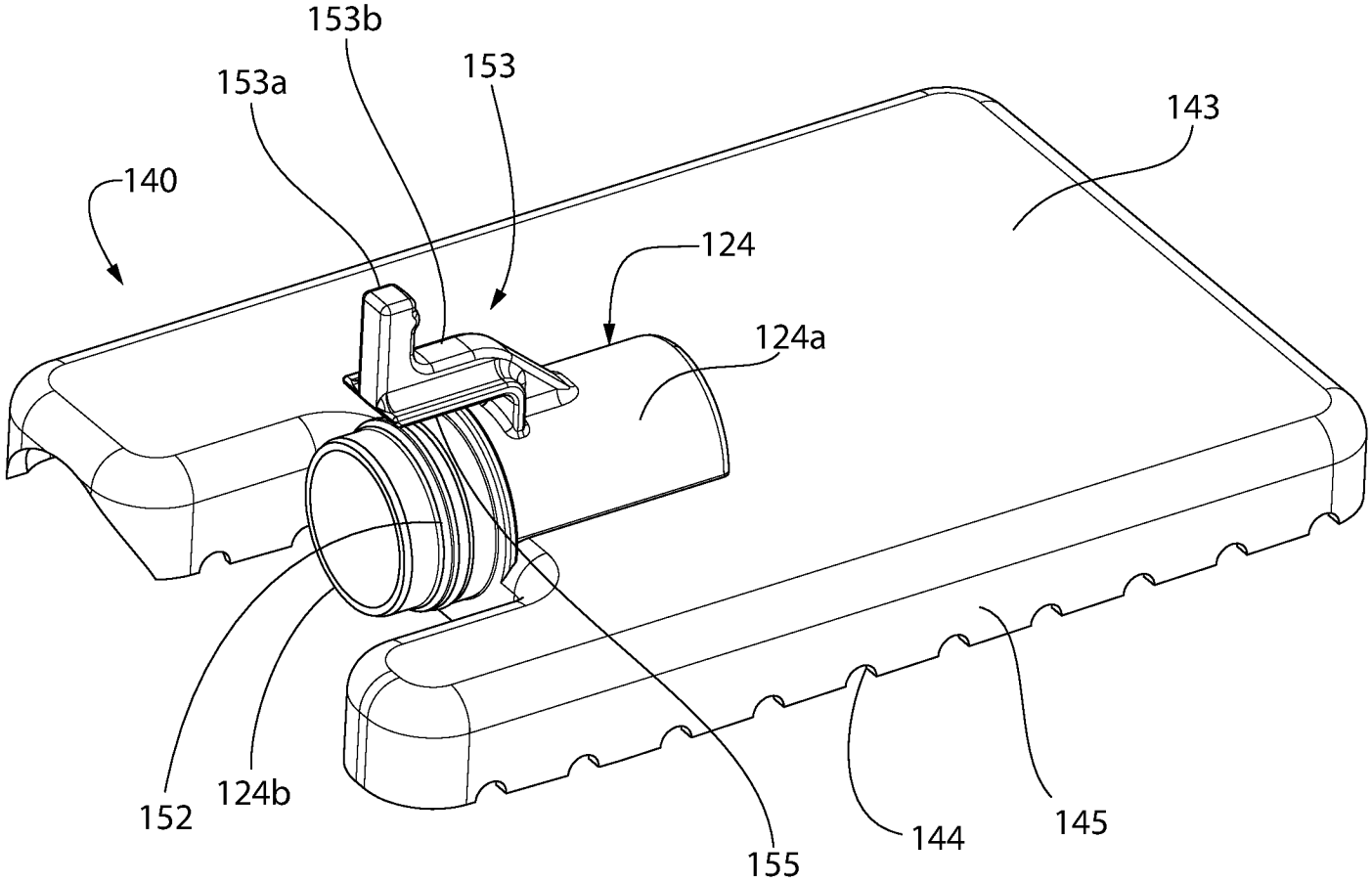
FIG. 18 is a first top perspective view of a second embodiment of a flow control baffle.
Figure 19:
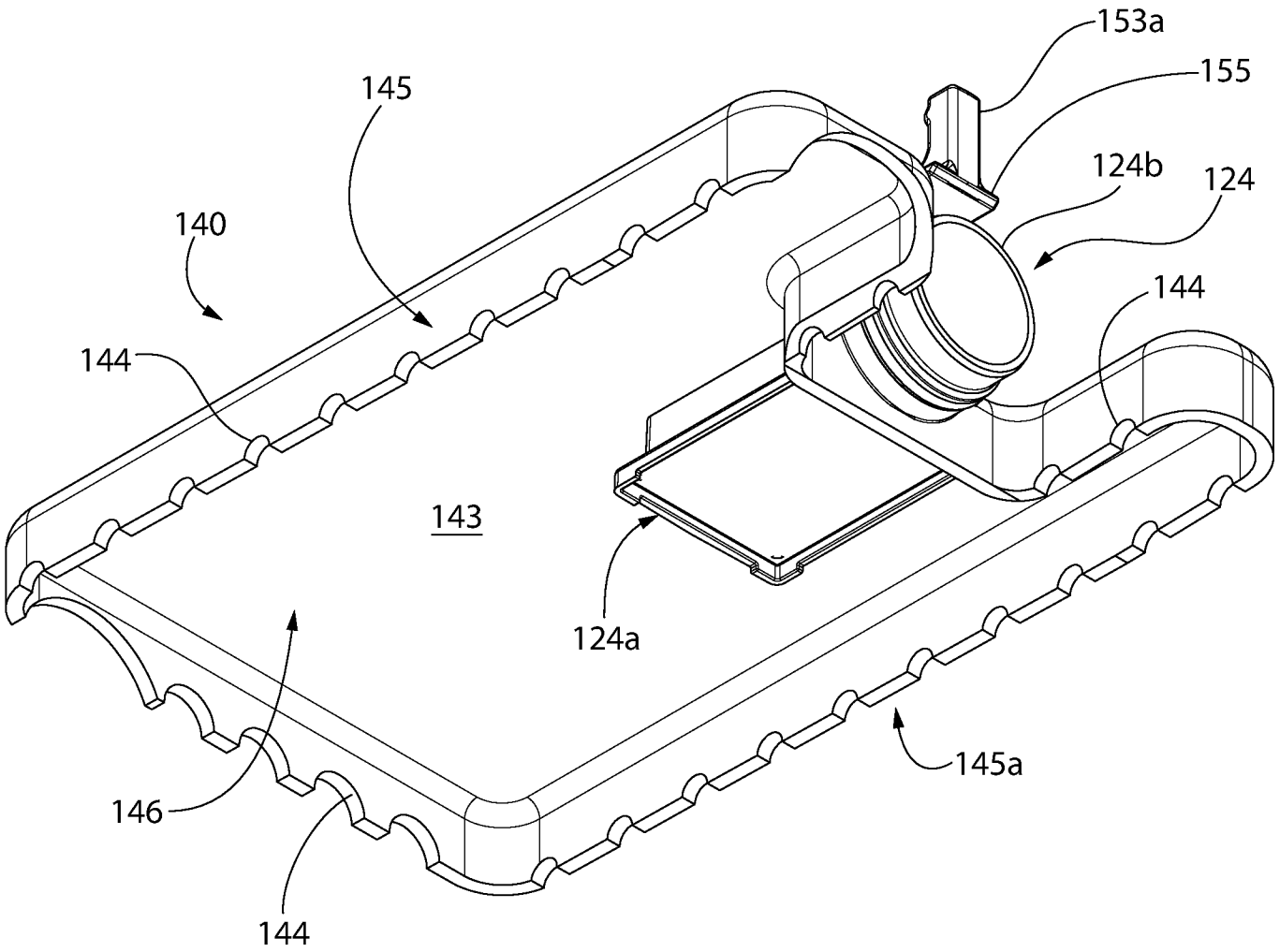
FIG. 19 is a bottom perspective view thereof.
Figure 20:
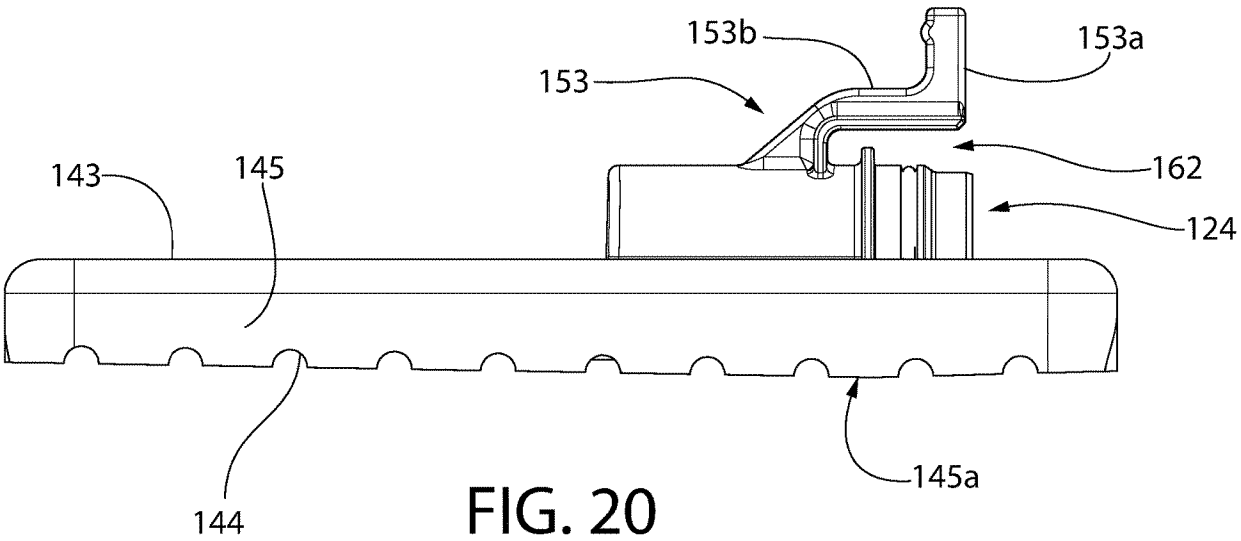
FIG. 20 is a first side view thereof.
Figure 21:
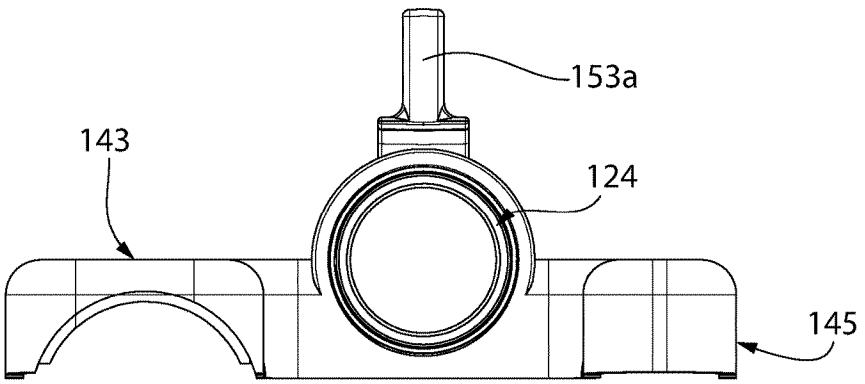
FIG. 21 is a second side view thereof.
Figure 22:
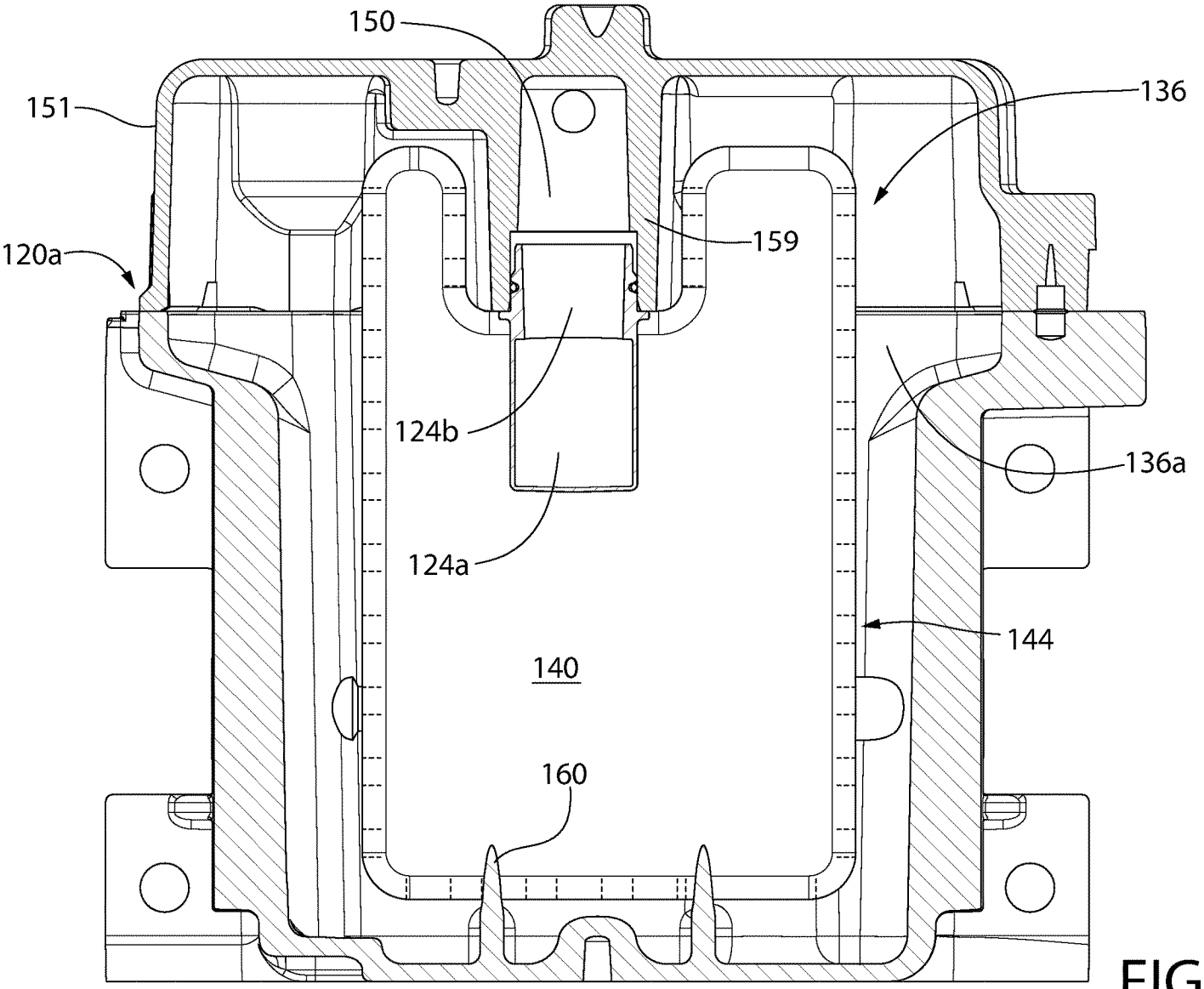
FIG. 22 is a transverse cross-sectional view of the crankcase portion of the engine showing a top plan view of the second embodiment of the flow control baffle.
Figure 23:
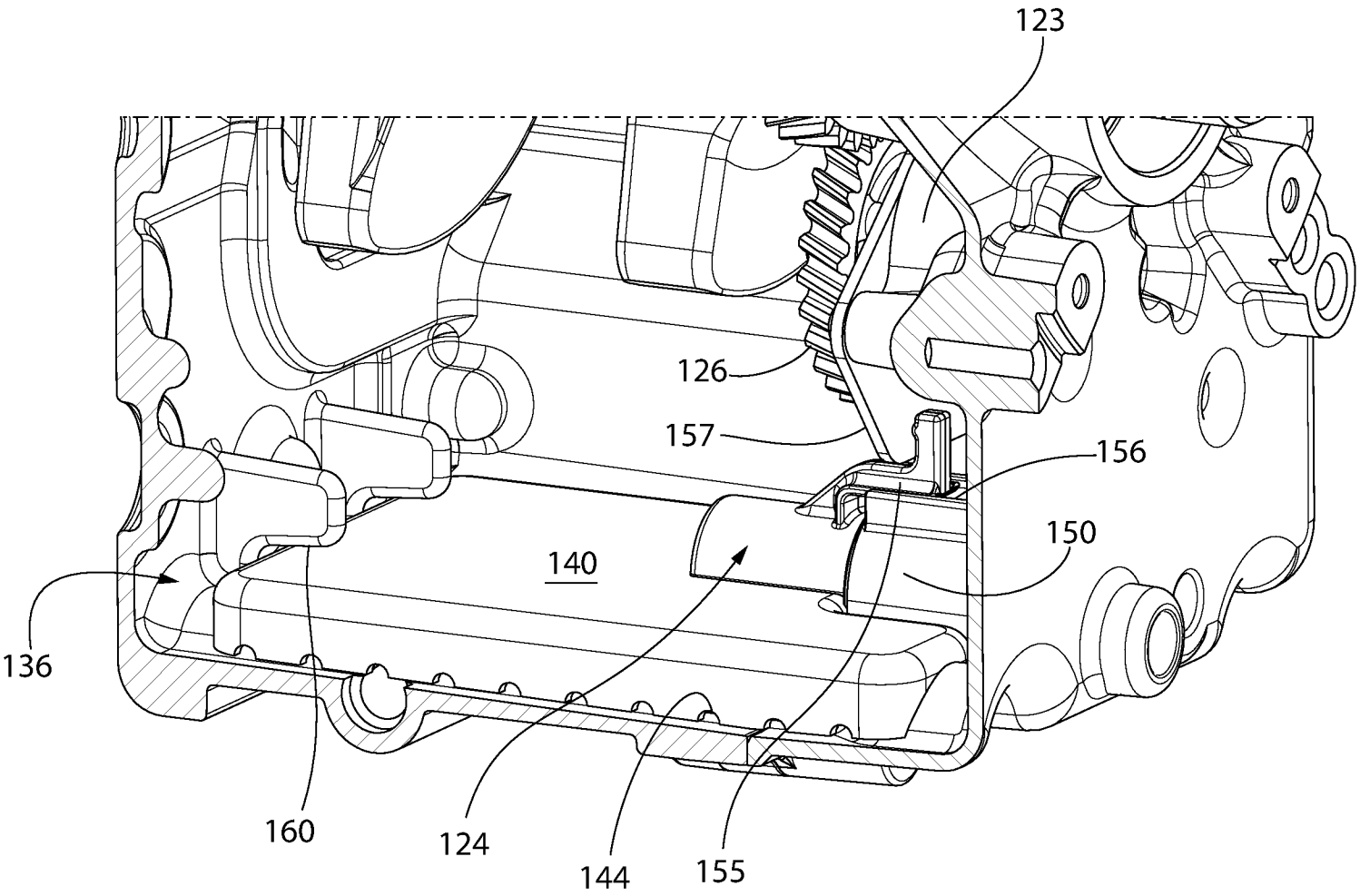
FIG. 23 is a first side perspective cross sectional view of the crankcase portion of the engine showing the second embodiment of the baffle.
Figure 24:
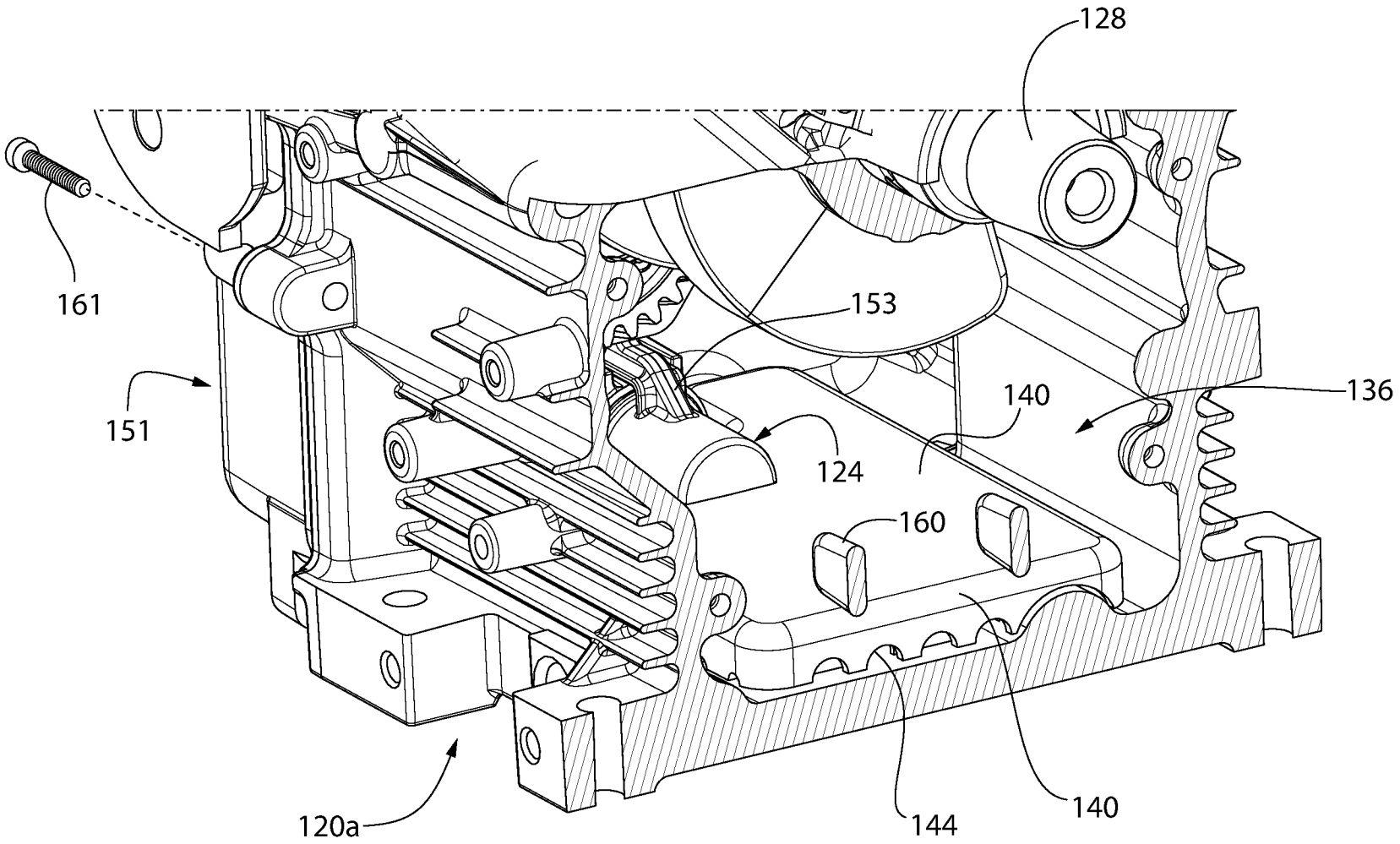
FIG. 24 is a second side perspective cross sectional view thereof.
Figure 25:
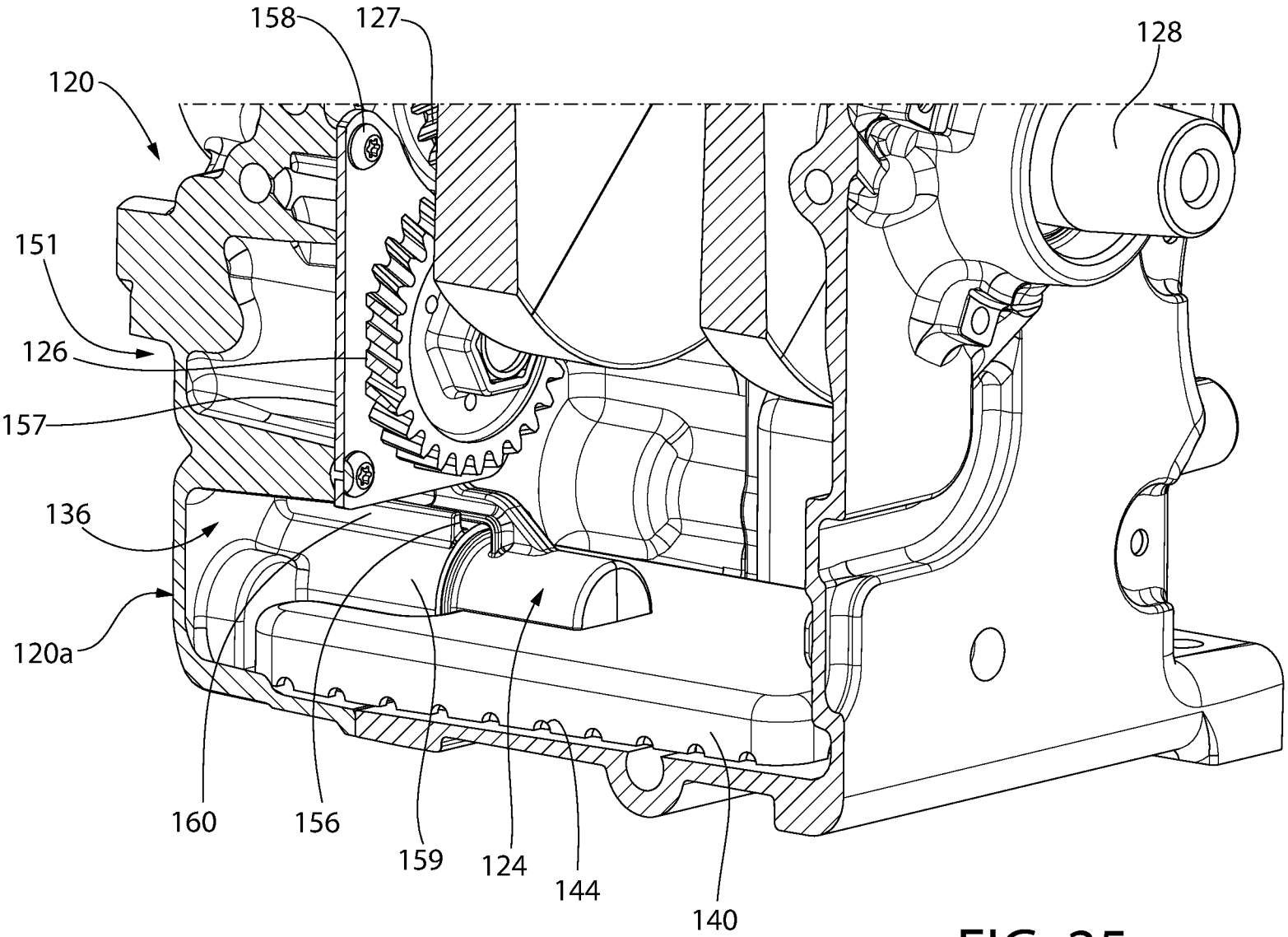
FIG. 25 is a third side perspective cross sectional view thereof.
Figure 26:
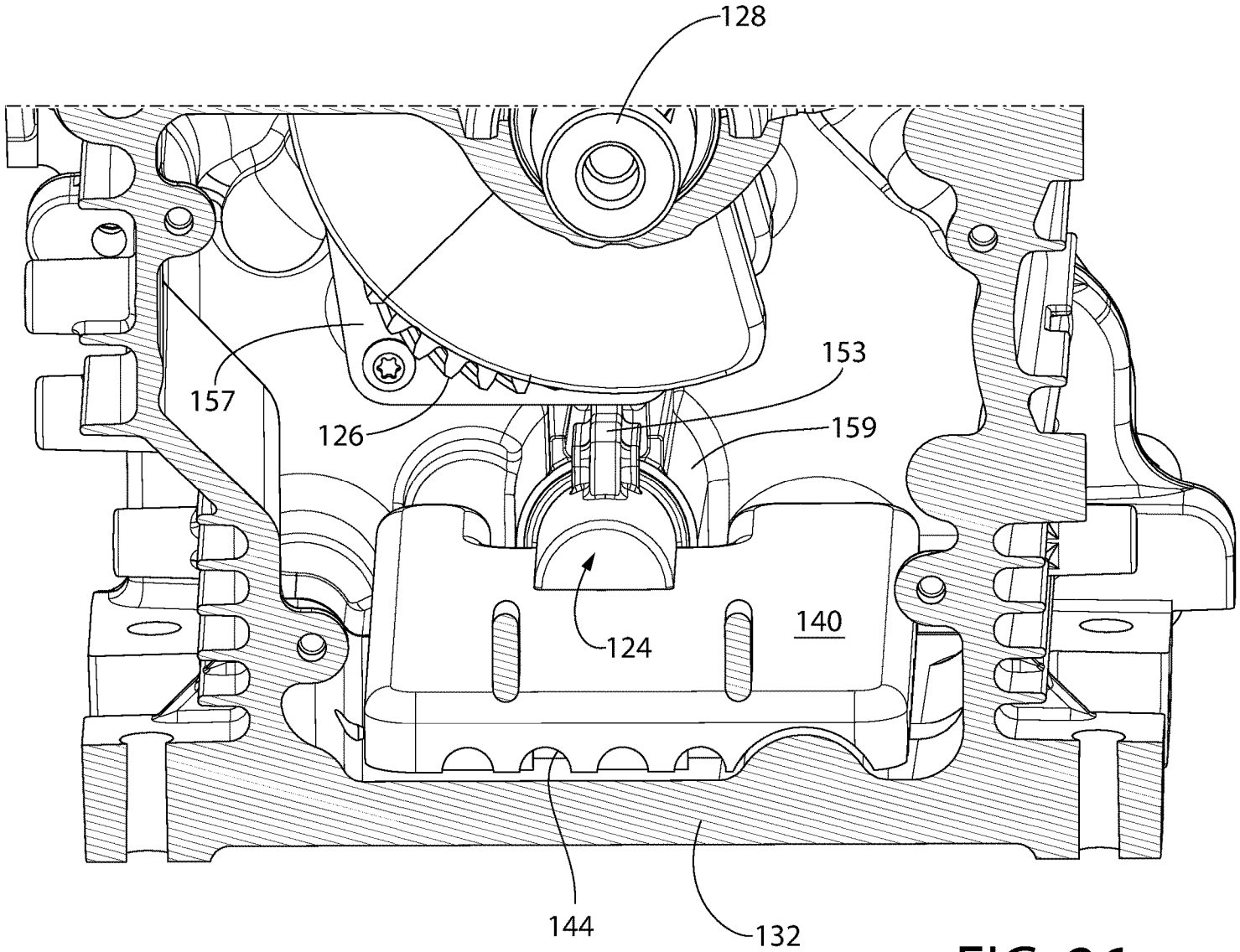
FIG. 26 is a fourth side perspective cross sectional view thereof.
Figure 27A:
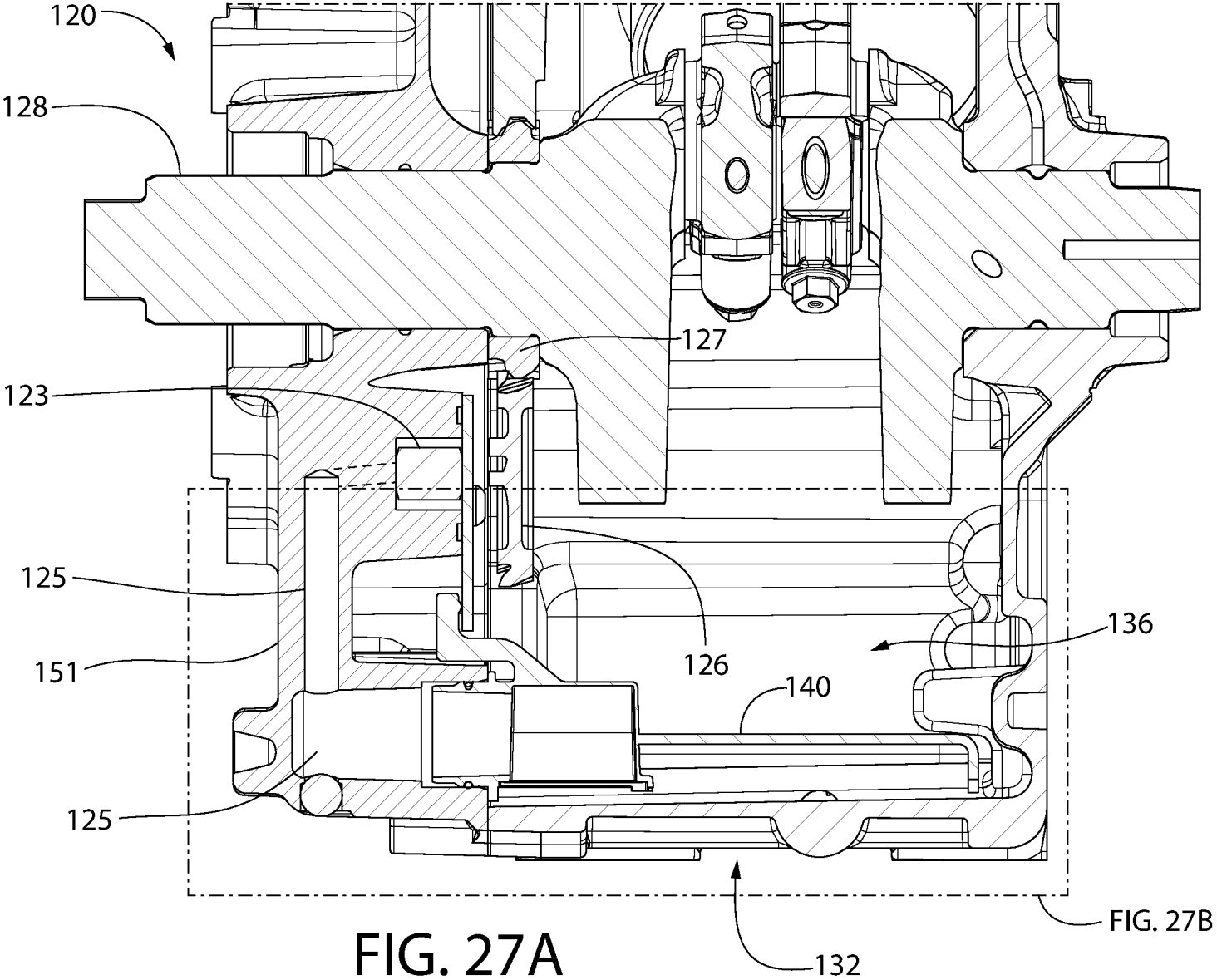
FIG. 27A is side cross sectional view thereof.
Figure 27B:
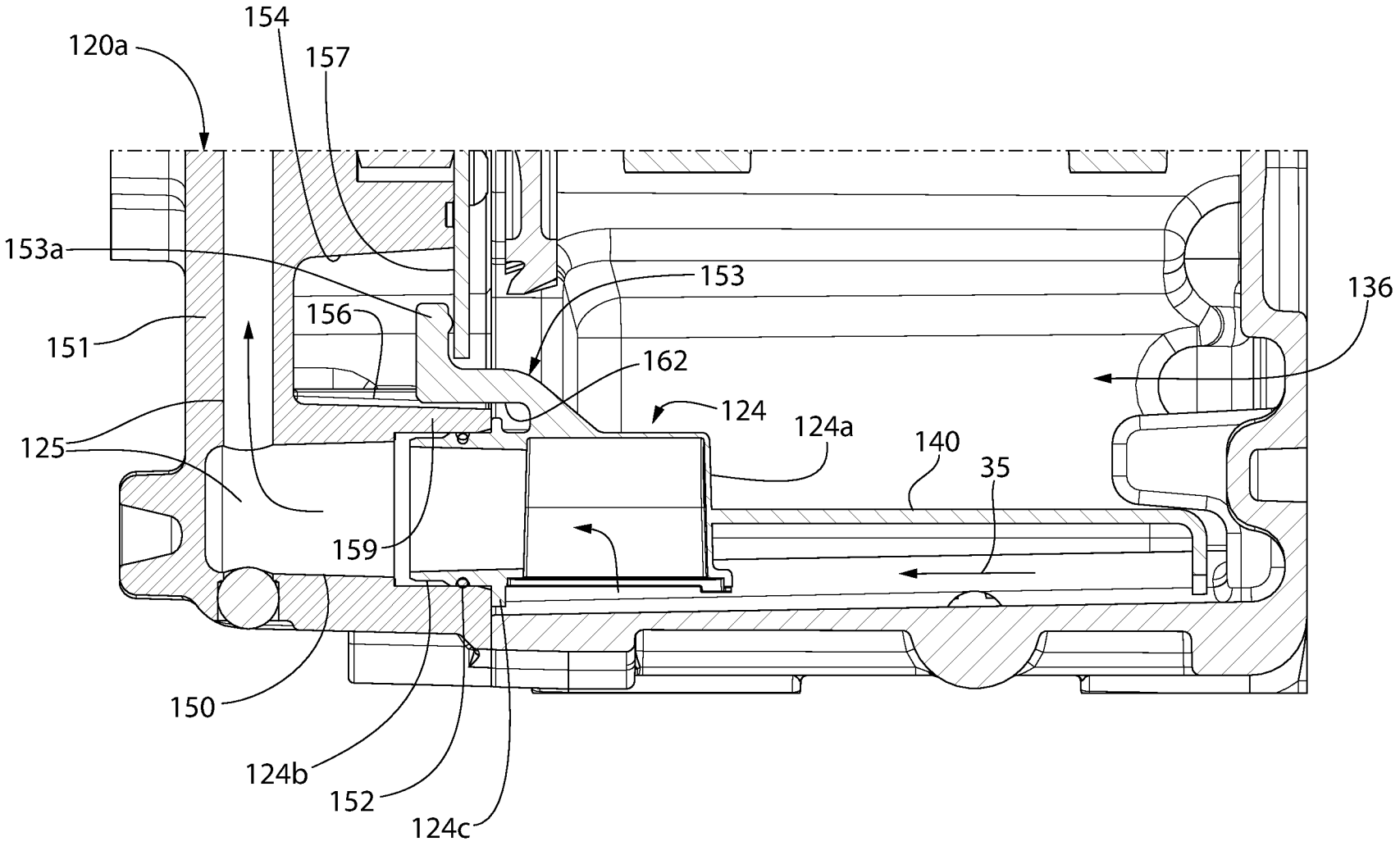
FIG. 27B is a detail taken from FIG. 27A.

According to one aspect, an oil flow control apparatus may be provided which is configured and operable to increase mixing and the resonance time oil in the oil pan 30 returning from the engine to maximize cooling of the oil. With particular reference to FIGS. 8 and 16-17, the apparatus in one implementation may comprise a flow control baffle 40 having a hood-shaped body formed by a shell including a top wall 43 and plurality of sidewalls 45 extending downwards therefrom which define an internal cavity 46. The bottom of the baffle may be fully open between the sidewalls when not mounted to the oil pan 30. A plurality of laterally-open oil inlet openings 44 may be formed through sidewalls 45 to place cavity 46 in fluid communication with the peripheral oil collection region 36*a* extending perimetrically and surrounding the baffle 40 in the recessed oil sump 36 (see, e.g. FIGS. 9 and 11). Region 36*a* may be comprised of plural sub-regions in the oil pan sump 36 which are located around a majority of or all sides of the baffle 40 in various designs. Sidewalls 45 may have contiguous structure which extends perimetrically around the entire periphery of the baffle 40 in some implementations. Cavity 46 is downwardly open (until baffle 40 is attached to oil pan 30) and defines a generally hollow baffle structure with generally open interior space in one implementation. Top wall 43 may be flat in one embodiment, or have any other suitable configuration including compound profiles with various undulating and/or raised/recessed portions of the surface. In some designs, the central portion of baffle top wall 43 may have a sloped surface configuration comprising a raised central portion with remaining peripheral portions sloping downwards towards sidewalls 45 to positively drain the returning oil into the peripheral region 36*a* around the baffle.

Flow control baffle 40 may have any suitable footprint or configuration in top plan view (looking downward at top wall 43) selected to complement the general plan view configuration of oil sump 36 in oil pan 30. In the non-limiting illustrated configuration, the sump and baffle may be considered to have a generally rectangular or square outline; however, the shape may be anything suitable including polygonal, non-polygonal, and combinations thereof. The sidewalls 45 of the baffle need not necessarily be straight or flat, but can be shaped as needed to match various projections or other features inside sump 36 of the oil pan as shown. Baffle sidewalls 45 may be sloped, flat, undulating, and combinations thereof in various implementations. In certain designs baffle 40 may be configured such that its sidewalls 45 are spaced inwards from the interior surfaces of the oil pan sidewalls 33 adjoining the oil sump 36 to form peripheral oil collection region 36*a* on some or all sides of the baffle.

Baffle 40 may be detachably mounted to oil pan 30 by any suitable means. In one implementation, fasteners 41 such as threaded bolts may be used which are inserted through mounting holes 41*a* in top wall 43 and received in corresponding threaded bores 31*a* formed in the oil pan. Bores 31*a* may be defined by raised mounting bosses 31 formed on bottom wall 32 of oil pan 30 in one non-limiting implementation. This minimizes the thickness of the bottom wall and weight of the oil pan rather than forming the threaded bores directly into the bottom wall. Other means of securing the baffle 40 directly or indirectly to oil pan 30 which do not involve the use of fasteners may be used (e.g. mechanical interlocking surfaces, entrapment, etc.); one example of which is shown in FIGS. 18-27 further described herein.

When installed, the bottom edges 45*a* of baffle sidewalls 45 may be positioned proximate to but need not necessarily contact the top surface of bottom wall 32 of the oil pan in sump 36. A slight gap between the top surface and bottom edges 45*a* will not allow oil in the sump from bypassing the oil inlet openings 44 in baffle sidewalls 45 since the openings 44 provide less resistance than such a minimal gap as oil is drawn inward into baffle cavity 46 by the suction force (vacuum) created by the oil pump intake nozzle 24. Some inward leakage beneath the edges 45*a* therefore does not significantly alter the effectiveness of the baffle for controlling the oil flow and cooling the oil. In some implementations, the bottom edges may be seated on and abuttingly contact part or all of the oil pan bottom wall 32. The bottom edges 45*a* may not all lie in the same horizontal plane, but can include vertically shorter or longer portions to accommodate various structures or features of the oil pan formed inside the oil sump 36 which may create undulating profiles.

Any suitable number and configuration of oil inlet openings 44 may be provided in the baffle sidewalls 45. In some implementations, each of the sidewalls (four total provided in the non-limiting illustrated construction) may include at least one inlet opening to draw return oil in the sump into cavity 46 of baffle 40 from all sides. In certain designs, oil inlet openings 44 are spaced apart along each sidewall 45 such that each sidewall contains a plurality of openings. In certain designs, the oil inlet openings 44 may be located at and intersect the bottom edge 45*a* of sidewalls 45, or be located slightly above the bottom edge to deter sludge accumulations in the peripheral collection region 36*a* from entering the baffle 40. In the non-limiting illustrated construction, the oil inlet openings may have a generally semi-circular shape as opposed to sharp corners which can induce unnecessary turbulence in the viscous oil flow entering into the baffle.

Flow control baffle 40 may further include an oil pump intake opening 42 which communicates with the internal cavity 46 of the baffle. Opening 42 may be formed in top wall 43 of the baffle and be of generally circular shape in one possible configuration. The oil pick-up or intake nozzle 24 associated with oil pump 23 passes through the intake opening into the cavity 46 of baffle 40 to take suction and withdraw oil from beneath and inside the baffle rather than directly from the oil sump 36 in the conventional manner. Since returning oil from the engine draining back to the sump in oil pan 30 cannot flow directly to the pump intake nozzle 24, the oil is forced to mix outside the baffle in peripheral collection region 36*a* before being drawn into baffle cavity 46 via the oil inlet openings 44. Opening 42 and concomitantly oil intake nozzle 24 may be offset towards one end or sidewall 44 of baffle 40. Other locations in top wall 43 may be used including at the geometric center of the baffle.

The annular interface formed between intake opening 42 and inlet nozzle 24 may be small creating a close fit therebetween to prevent any substantial amount of oil from entering the baffle cavity 46 through the interface rather than the lateral oil inlet openings 44 in the baffle 40. To enhance the fit-up and seal, an inwardly projecting annular lip or flange 42*a* may be formed at intake opening 42 in top wall 43 which projects downwards into baffle cavity 46. This creates a relatively closer interface thereby creating greater resistance to an substantial amount of oil being possibly drawn through therethrough from oil sump 36 into the baffle cavity 46 by oil pump 23. In some configurations, the pump oil intake nozzle 24 may have a diametrically enlarged lower portion 24*a* and a smaller adjoining upper portion configured for connection to the oil flow conduit 25 (see, e.g. FIG. 4). The bottom end of intake nozzle 24 may be spaced vertically apart from the top surface of bottom wall 32 of oil pan 30 by a gap or distance D1 to draw oil from baffle cavity 24 into the intake nozzle. The flange 42*a* may have frusto-conical shaped walls which converge towards the bottom to engage the pump intake nozzle 24 when inserted therethrough, thereby acting as travel stop to limit the insertion depth of nozzle in the baffle to achieve the desired gap or distance D1. Other configurations of the intake nozzle and arrangement of foregoing parts are possible.

Figure 4:
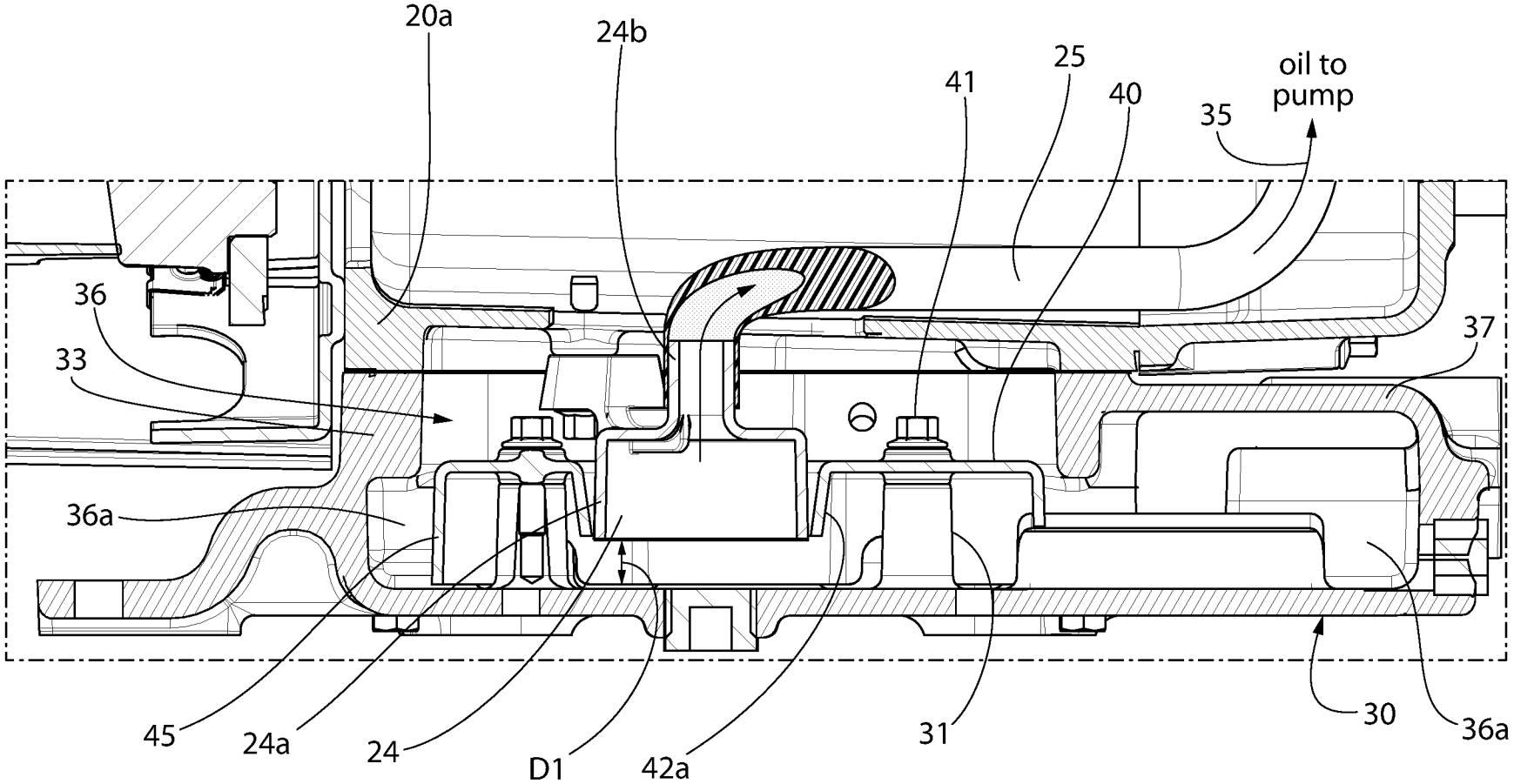
FIG. 4 is a first side cross-sectional view of the crankcase and oil pan.
Figure 5:
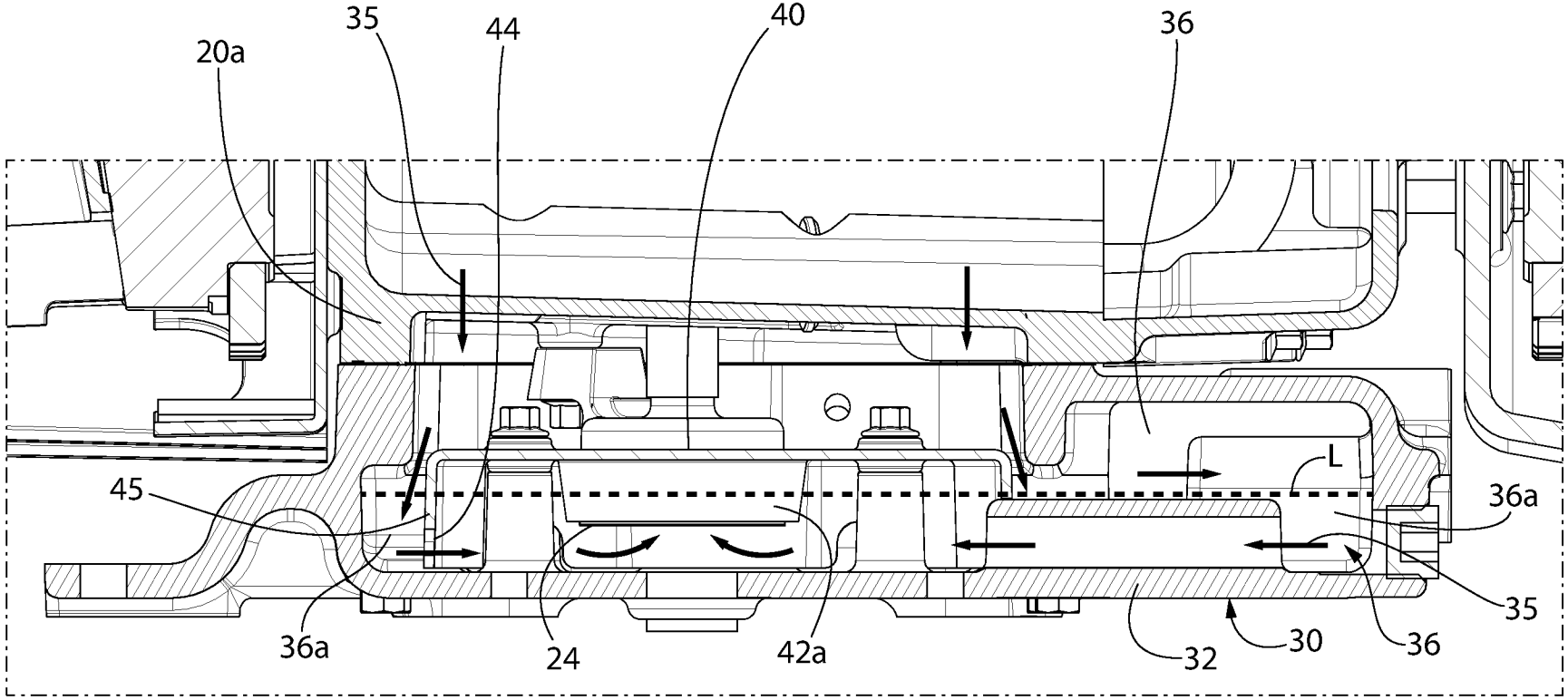
FIG. 5 is a second side cross sectional view thereof.
Figure 6:
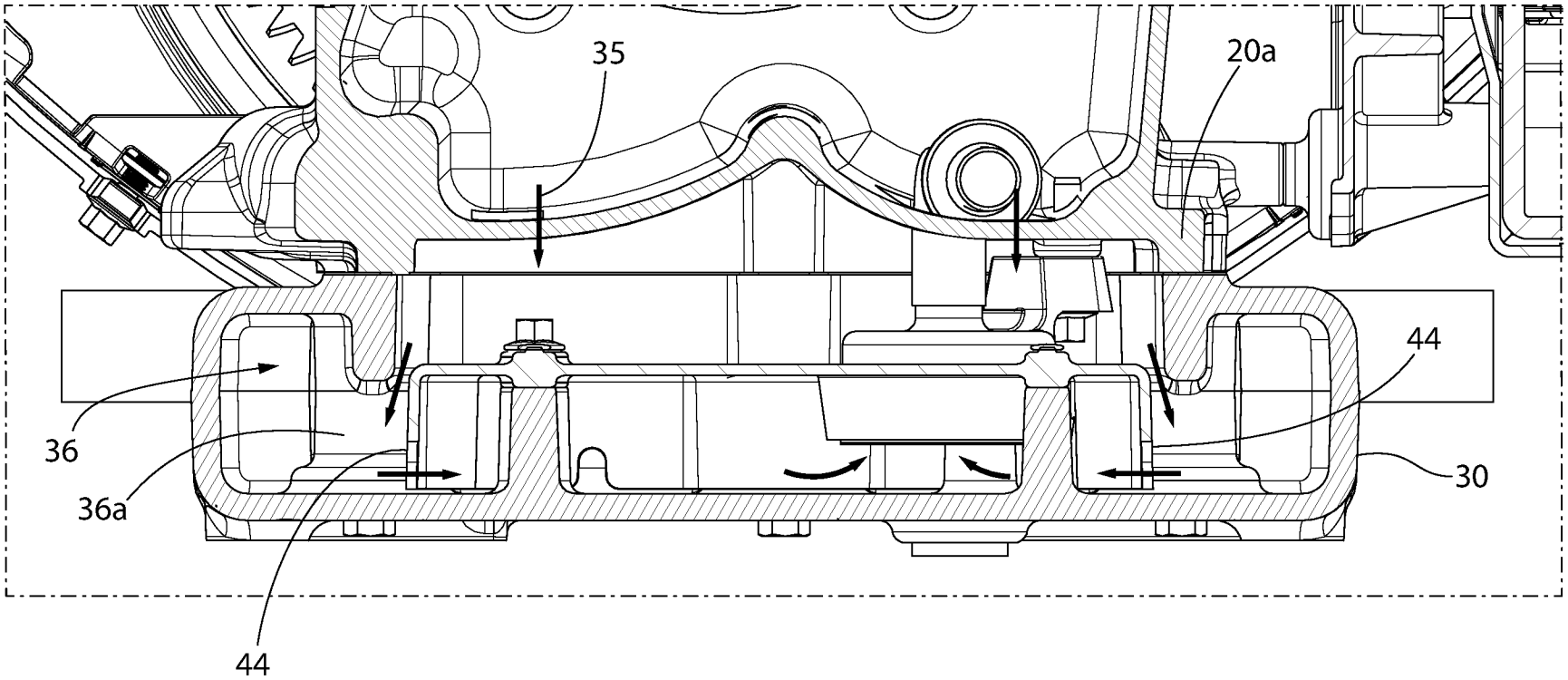
FIG. 6 is a third side cross sectional view thereof.
Figure 7:
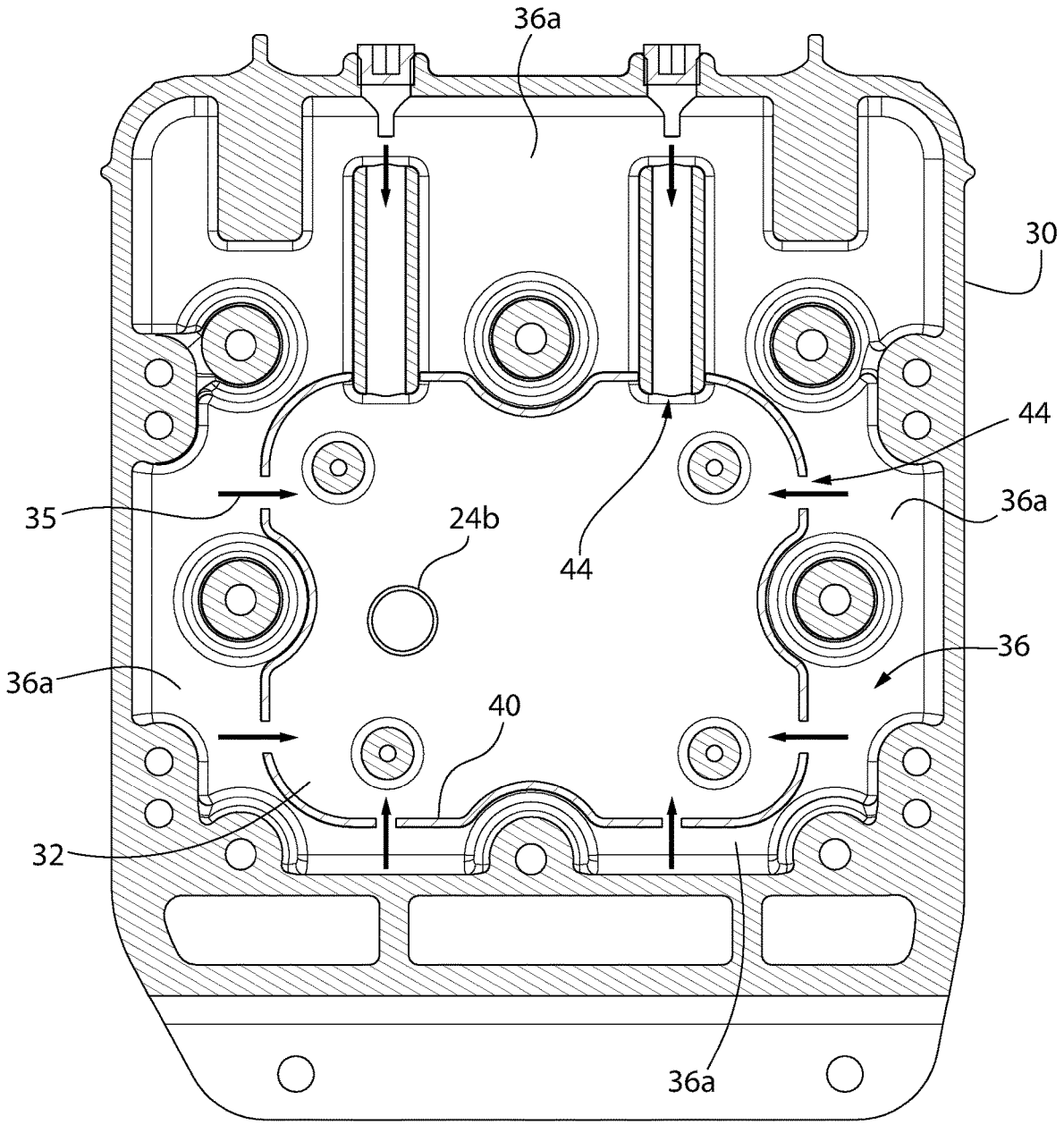
FIG. 7 is a transverse cross sectional view of the oil pan with flow control baffle.
Figure 34:
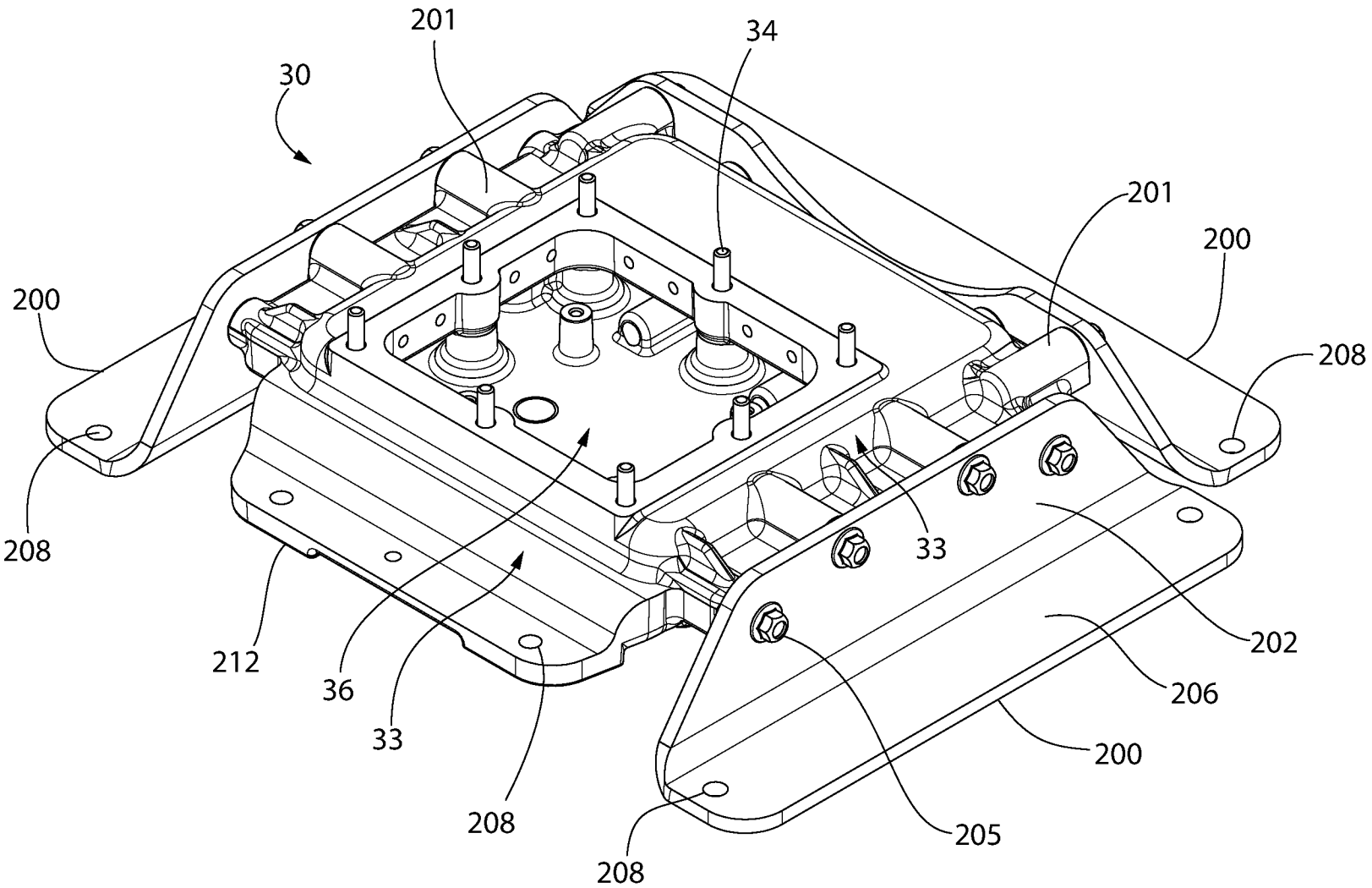
FIG. 34 is a top perspective view of the oil pan of FIG. 1 showing a modular engine mounting system according to another aspect of the disclosure.
Figure 35:
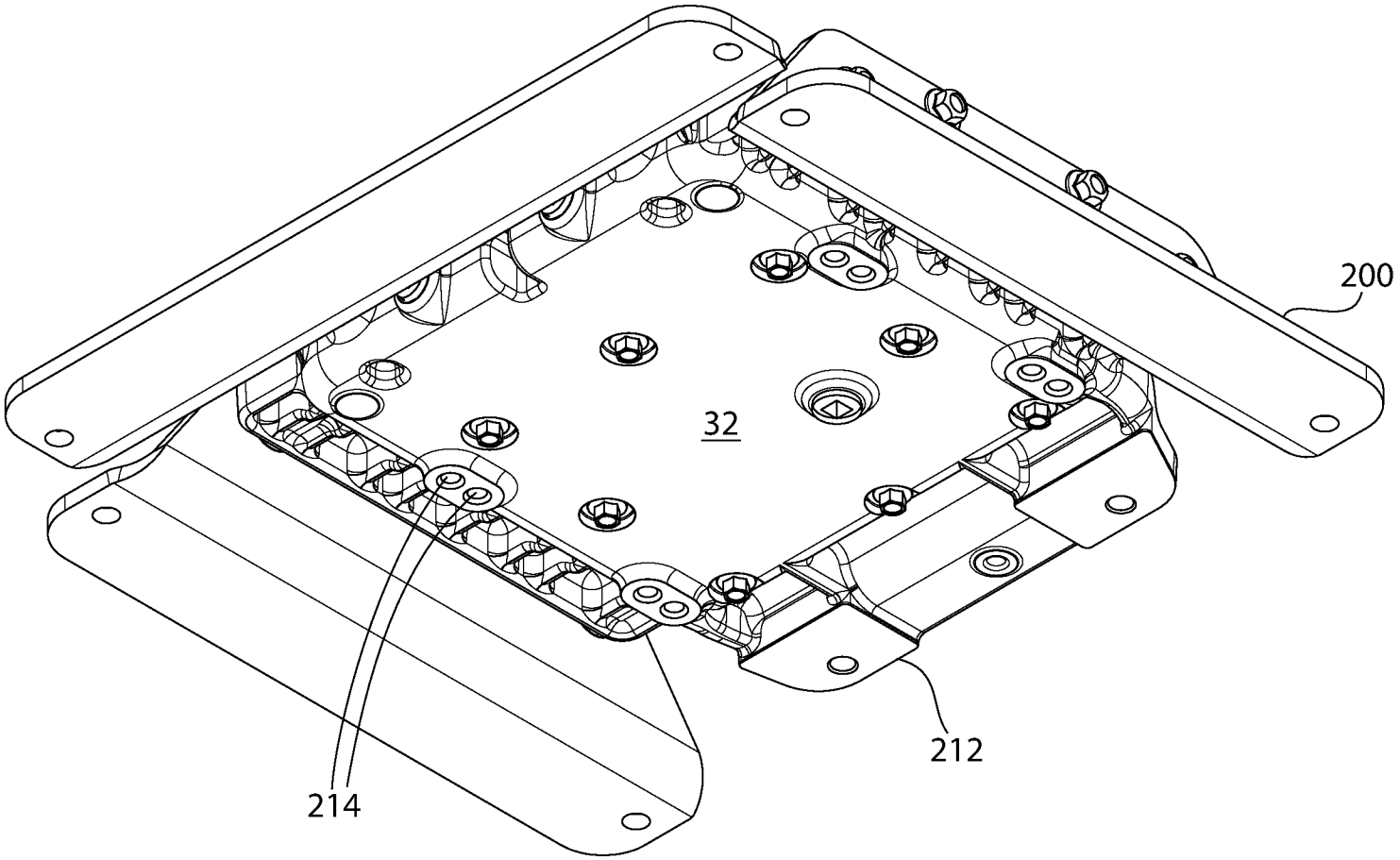
FIG. 35 is a bottom perspective view thereof.
Figure 36:
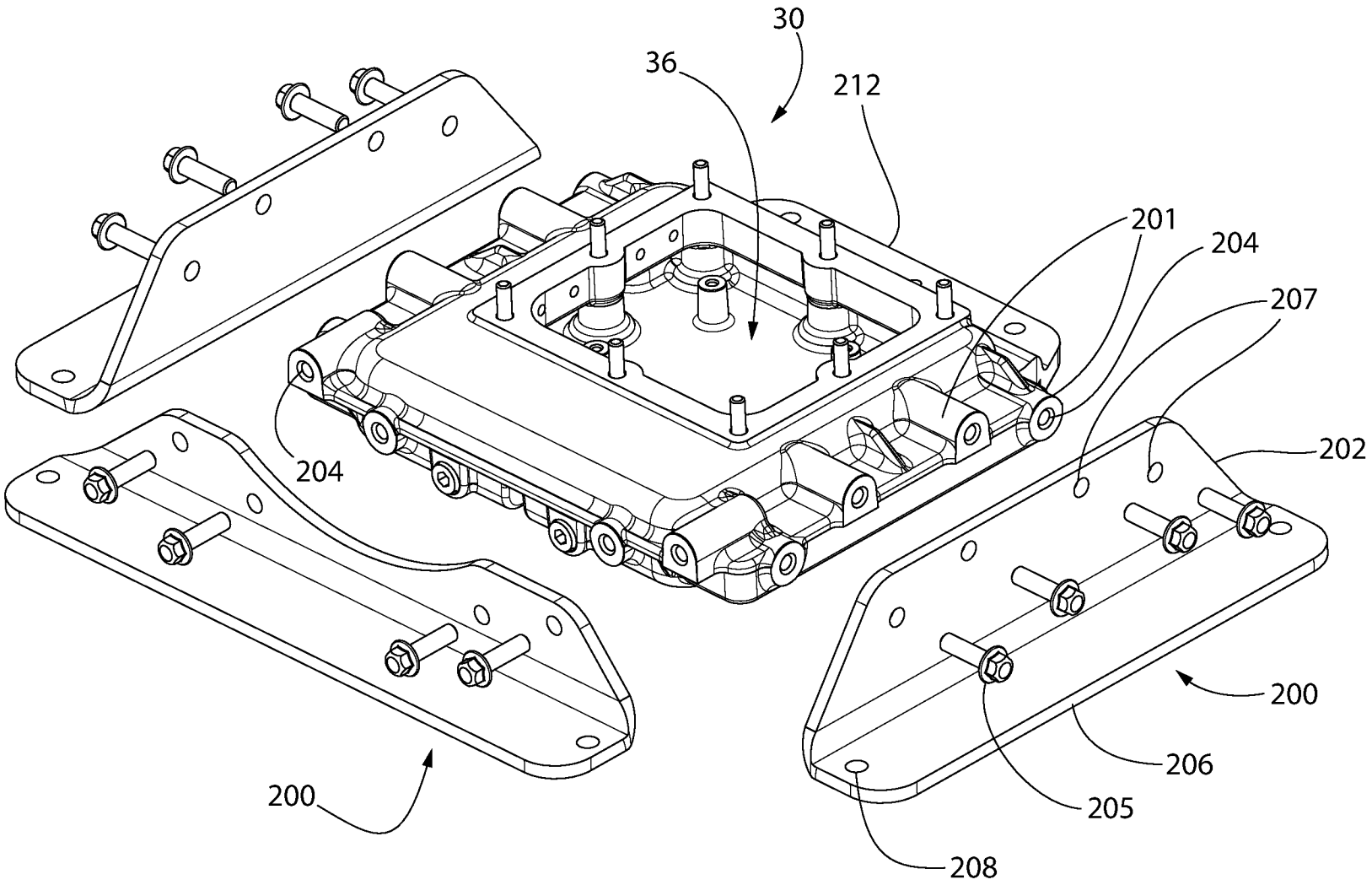
FIG. 36 is an exploded top perspective view thereof.

To assemble the flow control baffle 40 to the oil pan 30 before mounting the pan in turn to the engine crankcase 20*a*, the baffle is first positioned on bottom wall 31 of the oil pan 30 to concentrically align the pan's threaded bores 31*a* with the mounting holes 41*a* of the baffle (see, e.g. FIG. 4). Fasteners 41 are then threaded into each of their respective threaded bores 31*a* in the pan to secure the baffle to the pan. The oil pump intake nozzle 24 may then inserted through intake opening 42 in baffle 40 until it engages annular mounting flange 42*a* corresponding to the intake opening. The oil pan 30 is then mounted to the bottom of the engine crankcase 20*a* using fasteners 34 inserted through mounting through holes 34*a* accessible from the bottom 32 of oil pan 30 (see, e.g. FIGS. 2, 10, and 34). The lubricating oil flow control system is now ready for operation.

In operation, with particular reference to FIGS. 4-7, return oil from engine 20 flows by gravity back to the oil sump 36 of oil pan 30 (reference directional oil flow arrows). The oil initially remains outside of baffle 40 and collects in peripheral collection region 36*a* of oil pan 30 surrounding the baffle. The pump suction creates a negative pressure in cavity 46 of the baffle, which draws oil laterally inwards from the collection region 36*a* into the baffle through oil inlet openings 44 from all sides and corresponding lateral directions relative to the baffle in one non-limiting design. Once inside baffle cavity 46, the oil is drawn into intake nozzle 24 positioned at least partially inside baffle cavity 46 and flows upwards through the oil flow conduit 25 to oil pump 23, which pumps the oil through filter 29 for the distribution to the various engine parts requiring continuous lubrication while engine 20 is operating. The increased mixing and resonance time of the lubrication oil 35 in sump 36 advantageously improves cooling of the oil to maintain the lubrication properties and increase the useful life of the oil until it has degraded in viscosity to the point requiring replacement.

Flow control baffle 40 may be fabricated of any suitable material for this application by any suitable method depending on the metallic or non-metallic material selected for the baffle. Suitable methods include without limitation casting, stamping, molding, machining, combinations thereof, and others. In some non-limiting constructions, the baffle may be formed of injection molded plastic or die cast aluminum. Other suitable metals or which are chemically compatible for immersion in a heated lubricating oil environment may be used.

According to another aspect, a flow control baffle 140 is disclosed in FIGS. 18-27 for use in engines 120 that may not have a separable oil pan bolted to the crankcase of the engine. In such designs, the oil sump 136 may be integrally formed as part of the engine crankcase 120*a* casting at the bottom of the engine as shown. The bottom of the crankcase 120*a* with integral oil sump 136 defines the bottom wall 132 of the sump. Baffle 140 may share the same features as oil pan 40 for use with a separate oil pan 30 including plural oil inlet openings 44; accordingly, those same features will not be repeated here for the sake of brevity but where numbered will be distinguished by a "100" series part designation created by adding a "1" in front of the parts designation previously assigned with respect to the foregoing discussion of baffle 40. Some notable differences of the present baffle 140 and method for securing present baffle 140 to the integral oil pan are described below.

In the present engine 120 with integral oil sump 136, oil pump 123 and its associated oil pump gear 126 may be located below crankshaft 128 and drive gear 127 thereon which meshes with and rotates the oil pump gear. This arrangement is opposite that of engine 20 with detachable and separate oil pan 30.

Flow control baffle 140 may have a somewhat similar configuration and features as baffle 40 previously described herein. Baffle 140 includes top wall 143, sidewalls 145, internal cavity 146, and plurality of oil inlet openings 144 formed in sidewalls. Peripheral collection region 136*a* of the integral oil sump 136, where returning oil 35 from the engine accumulates as previously described herein, extends perimetrically around the baffle 140.

Flow control baffle 140 in one design may omit the oil pump intake nozzle opening 42 of previously described baffle 40 through which the pump intake nozzle 24 is inserted. Instead, an alternate oil intake nozzle 124 may be integrally formed as a unitary structural part of baffle 140. Alternatively, a separate nozzle may be detachably coupled to baffle 140 using a nozzle opening 42. Integrally formed intake nozzle 124 in the present baffle 140 being described may have a generally tubular body and projects laterally outwards from one lateral sidewall 45 of the baffle 140. Nozzle 124 may be formed in top wall 143 and extends partially therethrough into cavity 146 defining a downwardly open inlet portion 124*a* at a first end and laterally open cantilevered outlet portion 124*b* at an opposite free end. Portions of the nozzle body exposed above top wall 143 of baffle 140 and including the outlet portion 124*b* may be tubular shaped and circular in transverse cross section. Inlet portion 124*a* may have a polygonal cross-sectional shape creating an enlarged opening for better drawing oil from the cavity to the oil pump 23.

Oil intake nozzle 124 may be received and seated in a tapered oil inlet port 150 with circular cross-sectional shape formed in the crankcase 120*a* of engine 120. Port 150 may be formed in a detachable and removable side closure plate 151 of the crankcase in some implementations as shown. Port 150 in some implementations may be defined by oil intake boss 159 integrally cast or formed in the metallic crankcase closure plate 151 as a unitary structural part thereof. An O-ring 152 provided on the elongated outlet portion 124*b* of intake nozzle 124 forms a fluid seal between the inlet port and intake nozzle 124. Outlet portion 124*b* may include an annular stop flange 124*c* which engages the crankcase closure plate 151 (e.g. oil intake boss 159) to limit the insertion depth of the intake nozzle 124 in inlet port 150 to achieve a proper fit-up and liquid-tight seal (see, e.g. FIGS. 27A-B).

Oil inlet port 150 forms part of the oil flow conduit 125 leading from baffle 140 to oil pump 123 detachably mounted to the closure plate 151. Flow conduit 125 may be integrally formed with closure plate 151 as a unitary structural part thereof. Closure plate 151 may be formed of a suitable metal in some implementations, such as for example without limitation cast aluminum or another metal.

Baffle 140 includes retention features which collectively act to detachably retain the baffle in the integral oil sump 136 of the engine crankcase 120*a*. In one implementation, the retention features may advantageously couple baffle 140 to the crankcase without use of threaded fasteners via various interlocking elements. A first retention feature may be formed by a cantilevered retention arm 153. Arm 153 may be disposed on intake nozzle 124, or another portion of the baffle 140. Arm 153 may have an L-shaped configuration defining an upwardly projecting retention tab 153*a* at a free end and a horizontally extending horizontal section 153*b* arranged between the tab and partial tubular portion of the nozzle body visible on top of baffle 140. One end of horizontal section 153*b* formed an integral base of arm 153 connected to top wall 143 of baffle 140 and the opposite end transitions into the upstanding tab 153*a*. Horizontal section 153*b* extends over and may be spaced apart from oil intake nozzle 124 by a vertical gap forming an axial slot 162 beneath which slideably receives a top portion of an oil intake boss 159 formed in crankcase closure plate 151 (see, e.g. FIG. 27).

A portion of retention arm 153 including retention tab 153*a* may be received in an inwardly open entrapment pocket 154 formed in closure plate 151 which faces towards the baffle 140. Pocket 154 may be formed integrally with the closure plate. When positioned in pocket 154, tab 153*a* of the retention arm may be trapped and locked inside the pocket by a retention surface in the crankcase closure plate 151. In one design, the retention surface may be formed by a bottom edge of a pump cover plate 157 which may be detachably mounted attached to closure plate 151 by fasteners such as threaded fasteners 158 (see, e.g. FIG. 25), or another mounting means.

Retention arm 153 detachably secures a first end of the flow control baffle 140 to integral oil sump 136 of engine 120. An opposite second end of the baffle (which may be opposite intake nozzle 124 and retention arm 153) may be secured in the sump via a pair of laterally extending retention protrusions 160, which form a second retention feature. Protrusions 160 may be spaced horizontally apart and project inwards in the sump 136 towards baffle 140, as shown. Protrusions 160 may be tapered and the free ends of the protrusions may be rounded to facilitate entry of the baffle 140 beneath the protrusions, as further described herein.

A method or process for detachably mounting the present baffle 140 to the integrally formed oil sump 136 of the engine will now be described.

With crankcase closure plate 151 detached from crankcase 120*a* of engine 120, oil intake nozzle 124 of flow control baffle 140 is first slideably inserted fully into inlet port 150 in the crankcase closure plate. O-ring 153 forms a frictional fit and fluid seal therebetween which helps retain nozzle 124. A pair of laterally extending parallel guide flanges 155 formed at the base of retention arm 153 are slideably received in a guide channel 156 formed in closure plate 151 immediately above oil inlet port 150. Channel 156 may be defined by a pair of upwardly extending parallel rails 160 formed on oil intake boss 159 of crankcase closure plate 151, which defines the circular open oil inlet port 150 in crankcase 120*a*. Flanges 155 and channel 156 are elongated and act to guide retention arm 153 into entrapment pocket 154 of closure plate 151 as the oil intake nozzle 124 is inserted into the port 150.

With upstanding tab 153*a* of retention arm 153 now positioned in entrapment pocket 54 by slideably inserting the oil intake nozzle 124 in oil pump inlet port 150 of crankcase 120*a*, the pump cover plate 157 may then be attached to crankcase closure plate 151 via threaded fasteners 158. In one arrangement, the horizontal section 153*b* of retention arm 153 extends beneath a bottom edge of pump cover plate 157 and is trapped between the edge on top and rails 160 below on oil intake boss 159 (see, e.g. FIGS. 25 and 27). Retention tab 153*a* is trapped behind cover plate in pocket 54. Advantageously, this prevents the oil intake nozzle 124 from being axially withdrawn from oil inlet port 150 in the crankcase 120*a*. The closure plate 151 and cantilevered flow control baffle 140 extending laterally therefrom can now advantageously be lifted and maneuvered as a single self-supporting assembled unit which simplifies handling.

To next close up the crankcase 120*a* and install baffle 140 in the integral oil sump 136 of engine 120, the crankcase closure plate 151 (supporting baffle 140 in a secure cantilevered manner) is moved into position against the crankcase (e.g. open lateral side of the crankcase in one arrangement). During this positioning step, the end of baffle 140 opposite oil intake nozzle 124 is automatically slideably inserted beneath retention protrusions 160 in the crankcase. The tapered protrusions 160 in the crankcase act as "lead in" for the oil baffle and may have full contact with the oil baffle once the closure plate is fully assembly to the crankcase. The bottom edges 145*a* of the baffle sidewalls 145 may contact or be positioned proximate to the top surface defined by bottom wall 132 of the integral oil sump 136. Closure plate 151 may then be detachably secured to the crankcase via a plurality of bolts 161.

In some implementations, the baffle may include an internal oil flow control labyrinth 170 formed within the internal cavities 46/146 of baffles 40/140, respectively. The labyrinth may be configured to provide an even more circuitous oil flow path between the baffle oil inlet openings 44/144 of the baffles 40/140 and the oil pump intake nozzle 24/124. This advantageously increases the resonance time and cooling of oil 35 returned from the engine to the oil sumps 36/136. A non-limiting example of a labyrinth will be briefly described with reference to baffle 140 for use with an engine 120 having an integral oil sump 136 previously described herein. It will be appreciated that the same or variations of the labyrinth design and concept may be equally applied to baffle 40 previously described herein.

Figure 28:
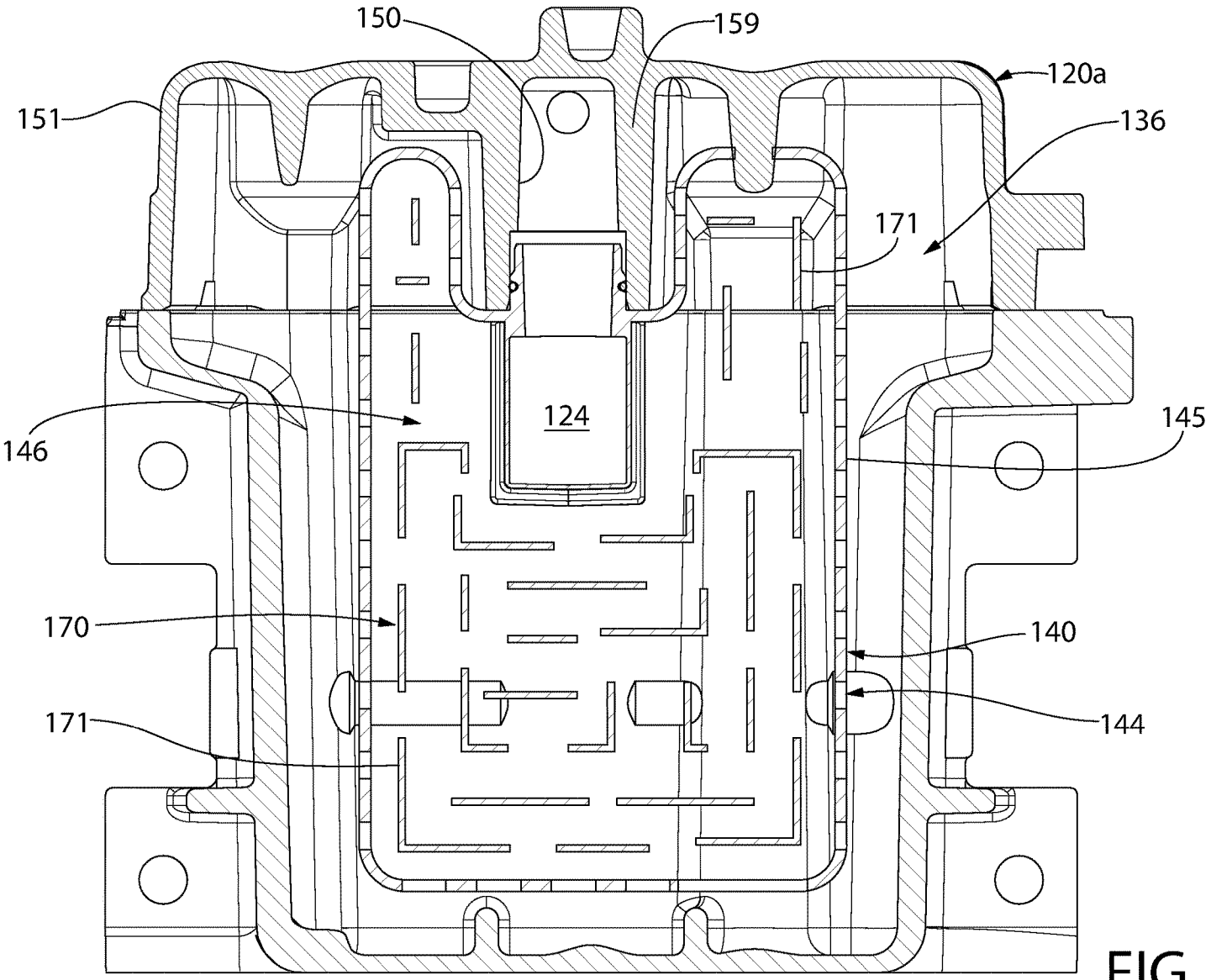
FIG. 28 is a transverse cross sectional view of the crankcase portion of the engine and the second embodiment of the baffle showing an optional flow control labyrinth.
Figure 29:
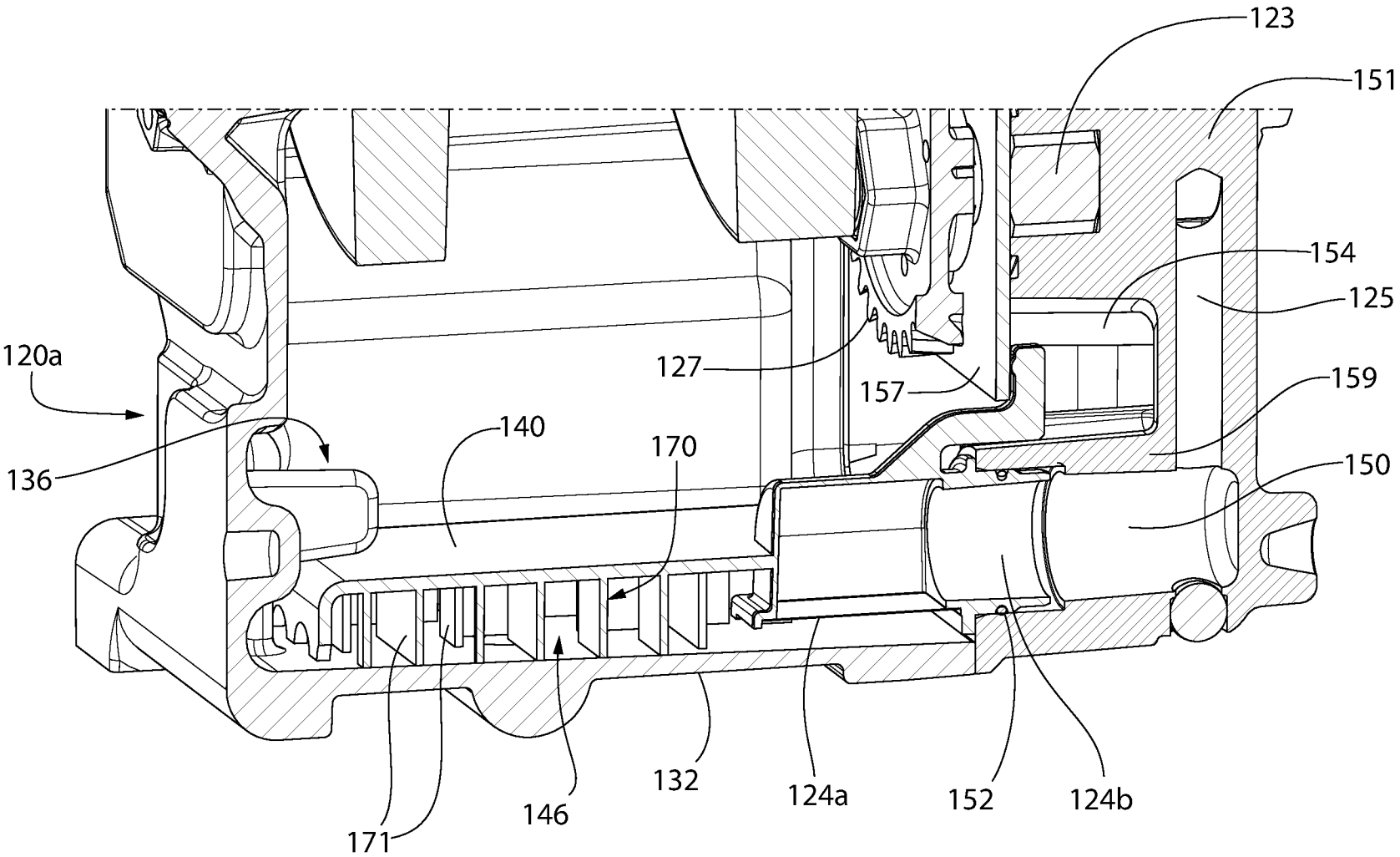
FIG. 29 is a side cross-sectional perspective view thereof.
Figure 30:
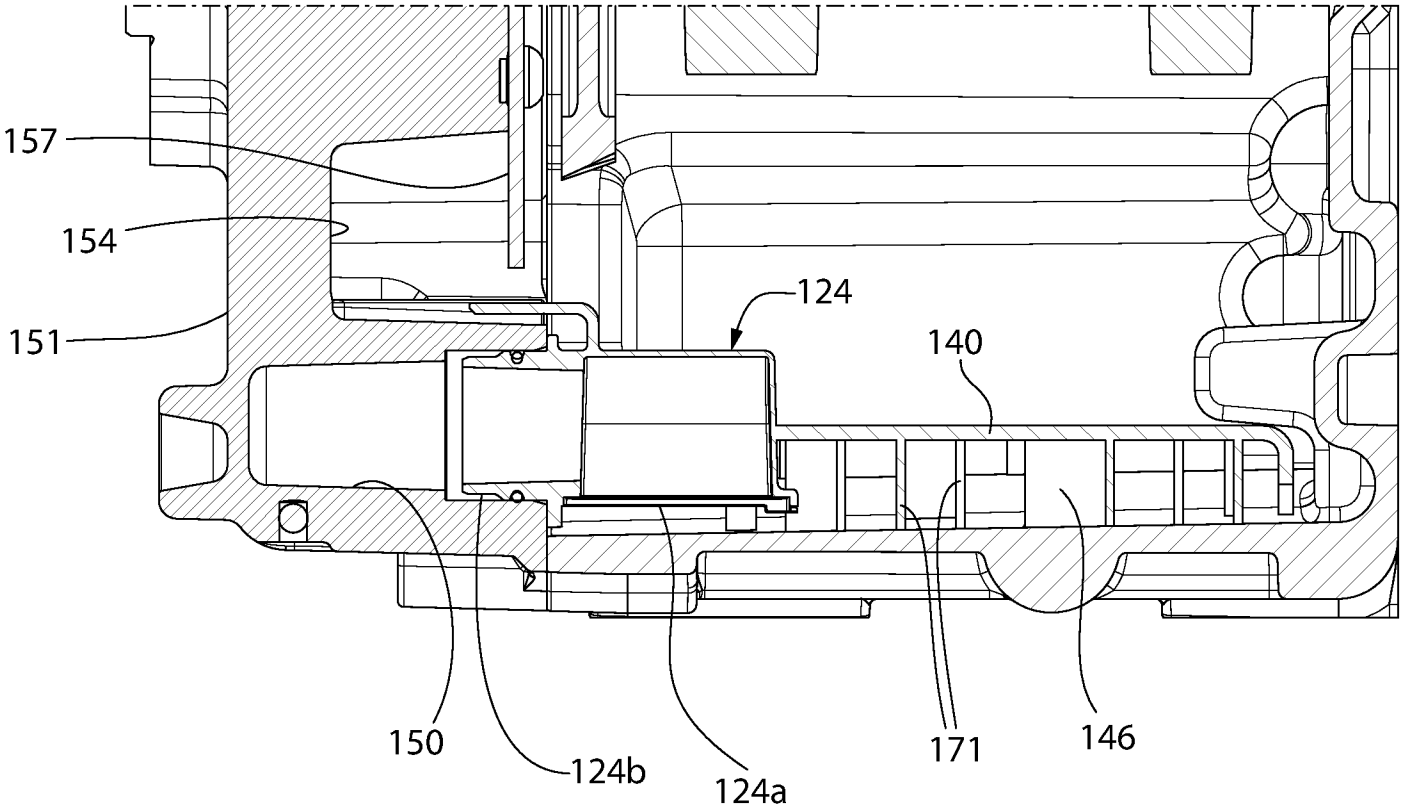
FIG. 30 is a side cross sectional view thereof.

Referring now to FIGS. 28-30, flow control labyrinth 170 may comprise a plurality of flow diversion walls 171 extending downwards from top wall 143 of baffle 140. Any pattern, configuration, and arrangement of walls 48 may be provided to create the desired circuitous oil return path to the oil intake nozzle 124 and resonance time increase. Walls 171 may have a height coextensive with the sidewalls 145 of baffle 140 in some arrangements. Walls 171 may be perpendicularly oriented relative to a horizontal plane defined top wall 143, and/or may be angled obliquely thereto. A combination of perpendicular and angled walls be may used. The diversion walls 171 may be arranged to steer oil flow entering baffle cavity 146 via the lateral oil inlet openings 144 in baffle sidewalls 145 such that at least a portion of the oil entering the cavity does not flow directly to the oil intake nozzle 124 in the top wall 143 of the baffle 140. The a plurality of flow diversion walls 171 may be arranged in different angular orientations with respect to each other (e.g. perpendicularly, obliquely, etc.) to establish the circuitous return oil flow path. In some arrangements, there may be no straight line of sight between at least a majority of the oil inlet openings and the intake nozzle such that a straight oil flow path therebetween is avoided. In some arrangements, no straight line of sight may exist between any of the oil inlet openings 144 and oil intake nozzle 124 due to the placement of the diversions walls 171. The diversion walls 171 may be molded, cast, or otherwise formed integrally with the baffle 140 as a unitary structural part thereof. In other designs, the diversion walls may be separate structures attached individually to baffle 140, or may be formed on a separate insert which is installed inside the baffle. In yet other possible designs contemplated, the diversion walls may instead be integrally formed as a unitary part of the engine crankcase bottom wall 132 rather than formed in the baffle 140. Any of the foregoing diversion wall construction options may be used, or others.

Figure 31:
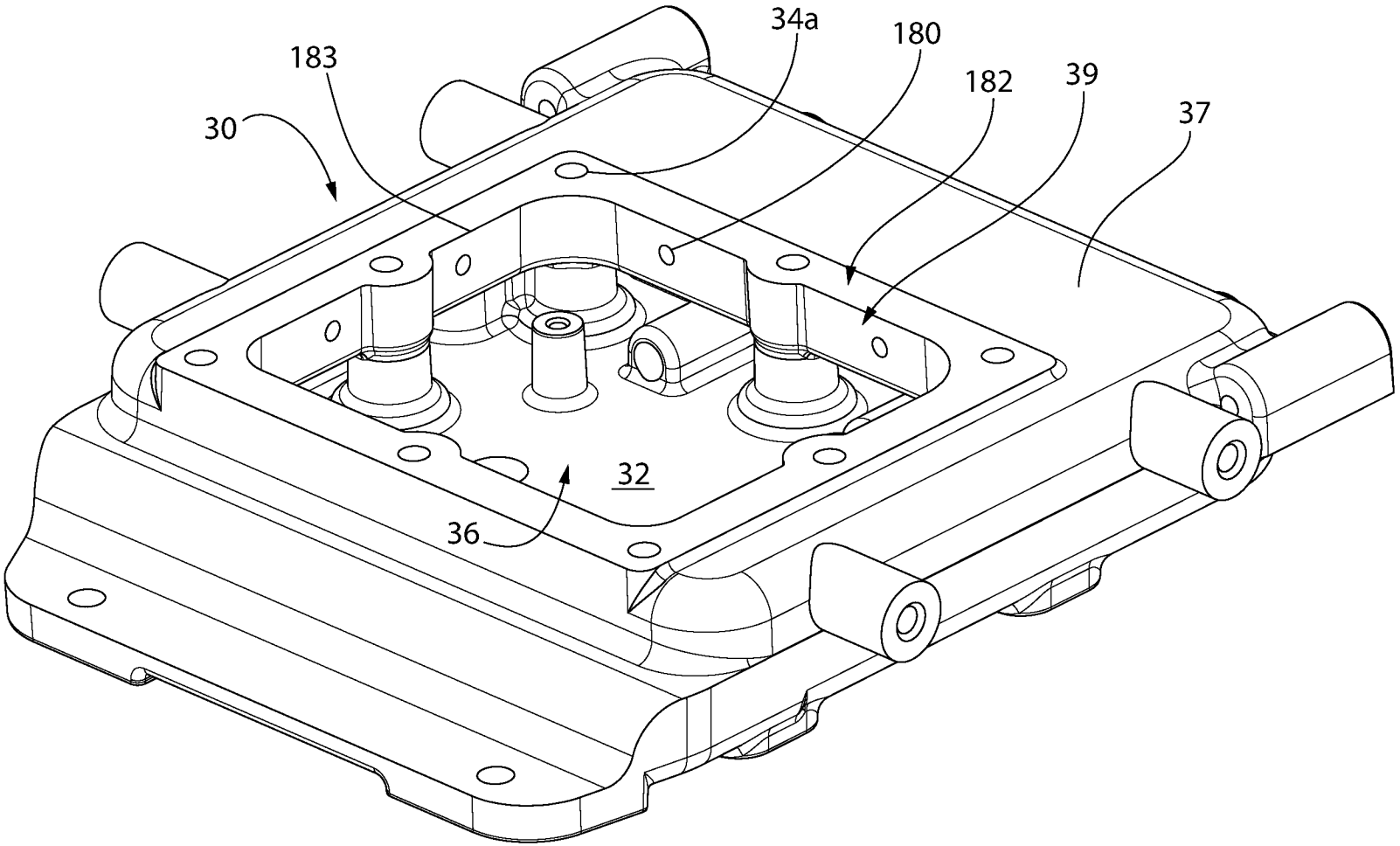
FIG. 31 is a top perspective view of the oil pan of FIG. 1 showing an optional air venting system.
Figure 32:
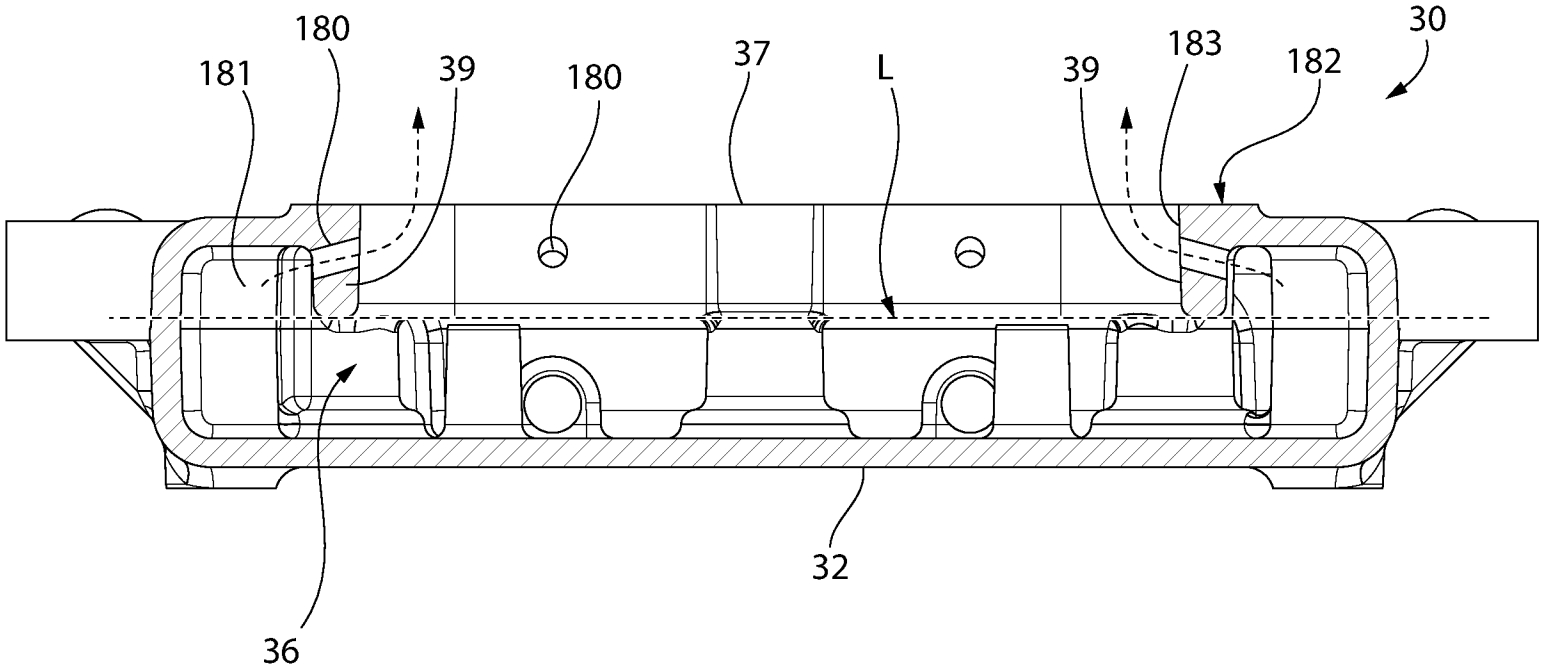
FIG. 32 is a first side cross sectional view thereof.
Figure 33:
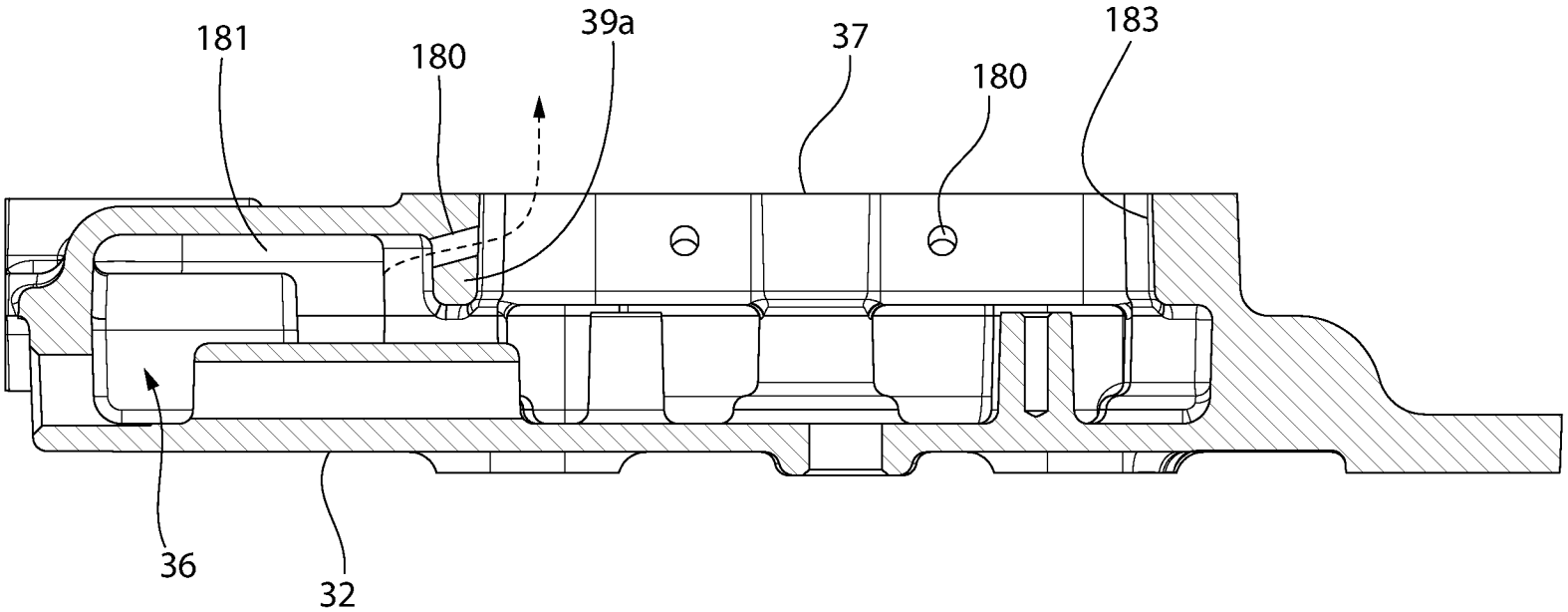
FIG. 33 is a second side cross sectional view thereof.

FIGS. 31-33 depict an integral air venting system associated with the detachable oil pan 30 according to the present disclosure. Maximizing the volumetric oil capacity of the oil pan while maintaining a small compact size and vertical profile is desirable to minimize spatial constraints for mounting the pan at the interface between the engine and vehicle frame. The present oil pan 30 maximizes oil capacity while reducing height of the pan by adding a plurality of vent holes 180 to utilize dead space 181 in the peripheral portions of the oil sump 36 outside of the pan mounting flange 39, which would otherwise contain trapped air which accumulates in the space above the oil when filled to the normal fill level L in the oil pan 30. The vent holes 30 allow the trapped air to be purged and forced out upwards out of the dead space 181 into the engine crankcase 20*a* as oil is filled and rises in the pan above the normal oil level L. The fill level can now be increased above normal fill level L without vent holes 180 so that the oil can now occupy at least a portion of dead space 181 normally filled with trapped air, thereby advantageously increasing the effective capacity of the oil pan 30.

As shown, air vent holes 180 are through holes which extend completely through a portion of the engine mounting flange 39. More particularly, engine mounting flange 39 comprises vertical walls 39*a* which project partially downwards from top wall 37 of oil pan 30 into the sump 36. Bottom ends of the walls 39*a* terminate a distance above the bottom wall 32 of the oil pan in the oil sump 36 to allow oil to flow into the peripheral regions of the oil sump beyond and outboard of the vertical walls. Mounting flange 39 forms a continuous polygonal structure (e.g. rectangular or square) defining a top opening 183 in the top wall 37 of the oil pan. Vent holes 180 extend generally laterally through the vertical walls 39*a* of the engine mounting flange and open therethrough into the top opening 783 which is in fluid communication with the crankcase 20*a* of the engine. The vent holes 180 may be located near the top of the peripheral dead space 181 of the oil sump 36 as shown in FIGS. 32-33 to purge as much trapped air as possible when the oil pan is filled with oil, thereby increasing the fill level and capacity of the sump to a maximum. A flat top interface surface 182 defined by the mounting flange receives a gasket (not shown) for forming a seal between the oil pan 30 and engine crankcase 20*a*. The mounting through holes 34*a* for bolting the oil pan to the crankcase penetrate the top surface 182 of mounting flange 39 as shown. Any suitable number, arrangement, configuration, and size of vent holes 181 may be provided as desired to evacuate trapped air in peripheral collection region 36*a* of oil sump 36.

According to another aspect, the oil pan 30 may further include a highly configurable and adaptable universal mounting system for mounting the engine to a plurality of different engine mount arrangements provided with a vehicle frame or chassis. The universal mounting system may be a modular system, which comprises a plurality of interchangeable mounting flanges which can be detachably coupled to the oil pan. Each mounting flange has a distinct bolt pattern configured to match the bolt pattern for the engine mounts on a particular vehicle chassis. This advantageously extends the number of engines and vehicle chassis/frames in which the oil pan may be used.

The oil pan 30 may therefore have a structurally robust construction to serve as a "load bearing" intermediate engine mounting component or interface arranged between the engine mounts of the vehicle chassis and the crankcase 20*a* of the engine 20. Oil pan sidewalls 33 therefore have a sufficient thickness for structural strength to transfer the entire weight of the engine to the vehicle chassis through the oil pan. This starkly contrasts to thin-walled non-load bearing oil pans often formed of sheet metal or the like which simply supports their own weight from the engine crankcase.

Referring now to FIGS. 10 and 34-42, the modular engine mounting system may comprise one or more laterally/horizontally elongated engine mounting flanges 200. Flanges 200 may be configured for detachable mounting to a plurality of structurally-reinforced bolt mounting bosses 201 formed on at least one sidewall 33 of the oil pan 30. In some embodiments, two, three, or all four sidewalls of the oil pan 30 may include mounting bosses. Bosses 201 may include internally threaded bores 204 which rotatably receive threaded fasteners such as mounting bolts 205 having a mating thread pattern. The bosses and bores have a suitable length to match and fully threadably engage the shanks of the bolts. Any suitable pattern/arrangement, bore diameter, thread type/pitch, and number of mounting bosses may be used as needed to rigidly affix the mounting flanges 200 to oil pan 30 and support the weight of the engine.

Mounting flanges 200 may be formed of steel plate bent to shape and of suitable thickness to provide rigid support of the engine from the vehicle chassis. In one non-limiting example, the flanges may have a representative thickness of about 8 mm (0.32 inches). The thickness will of course vary depending on the combined weight of the engine 20 and oil pan 30 to be supported in a cantilevered manner by the flanges 200.

Figure 37:
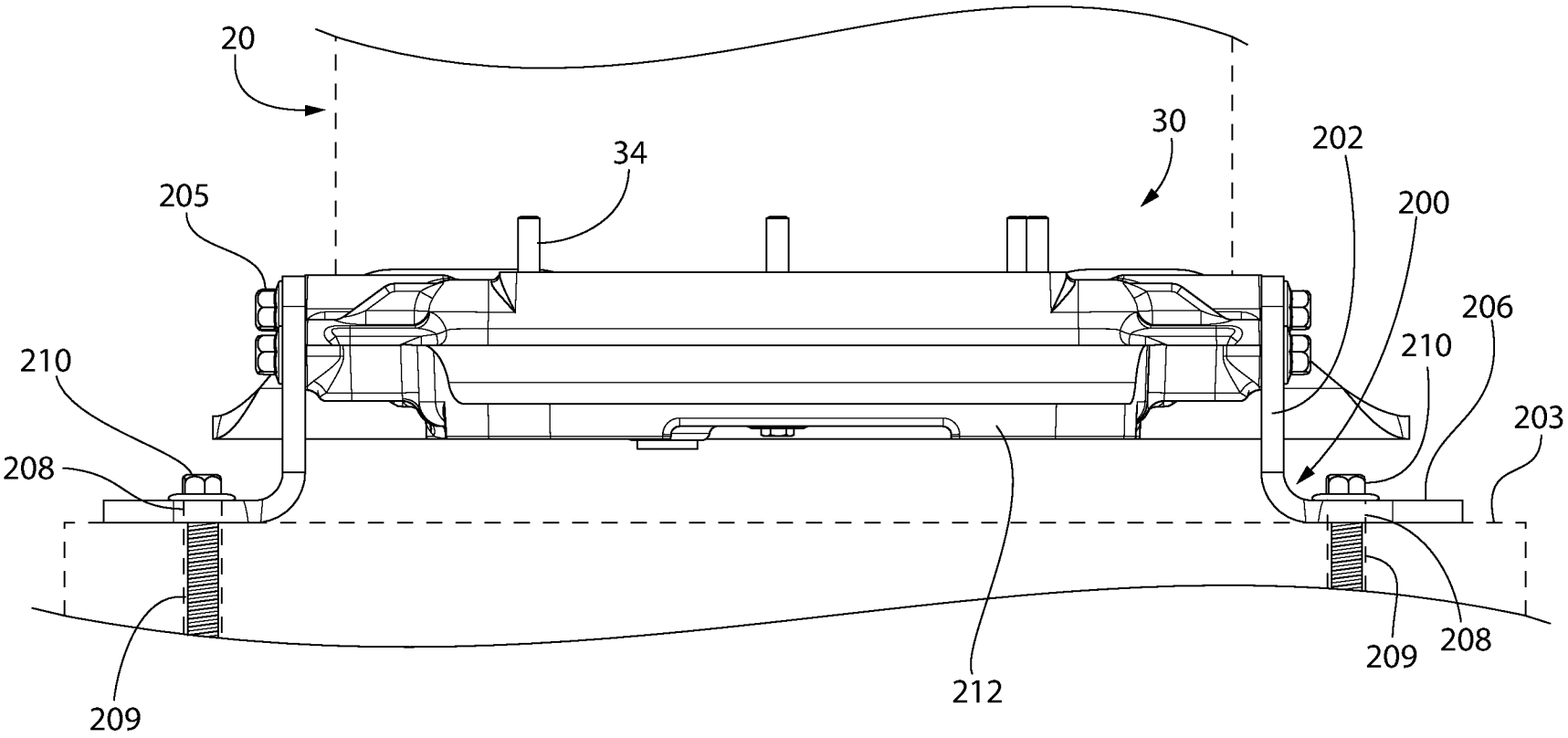
FIG. 37 is a first side view thereof.
Figure 38:
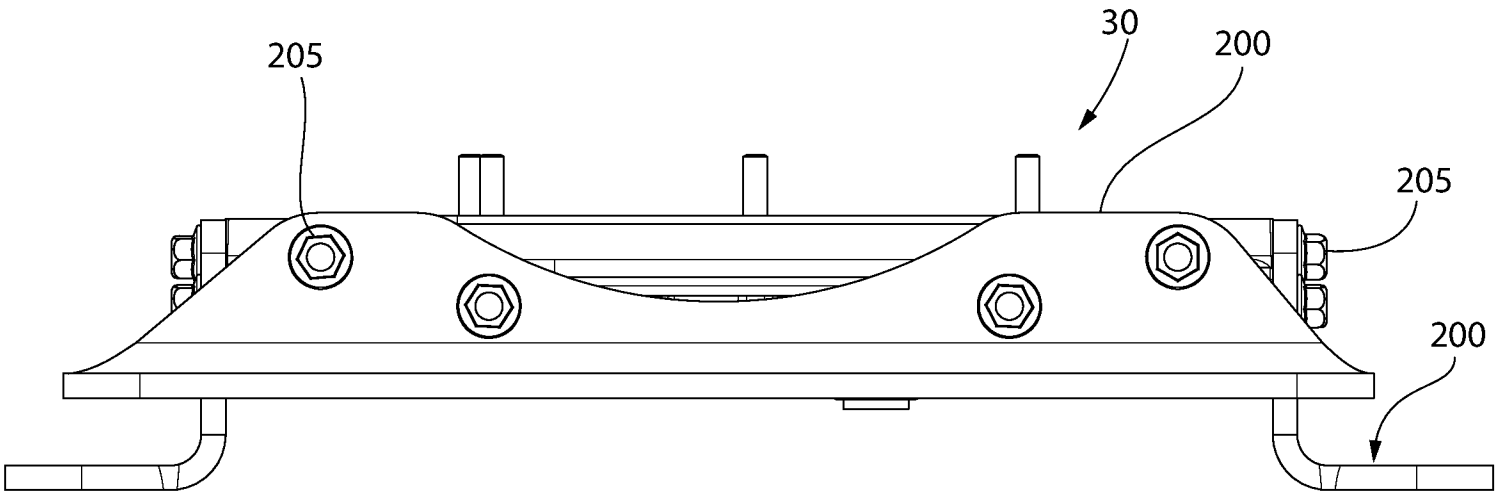
FIG. 38 is a second side view thereof.
Figure 39:
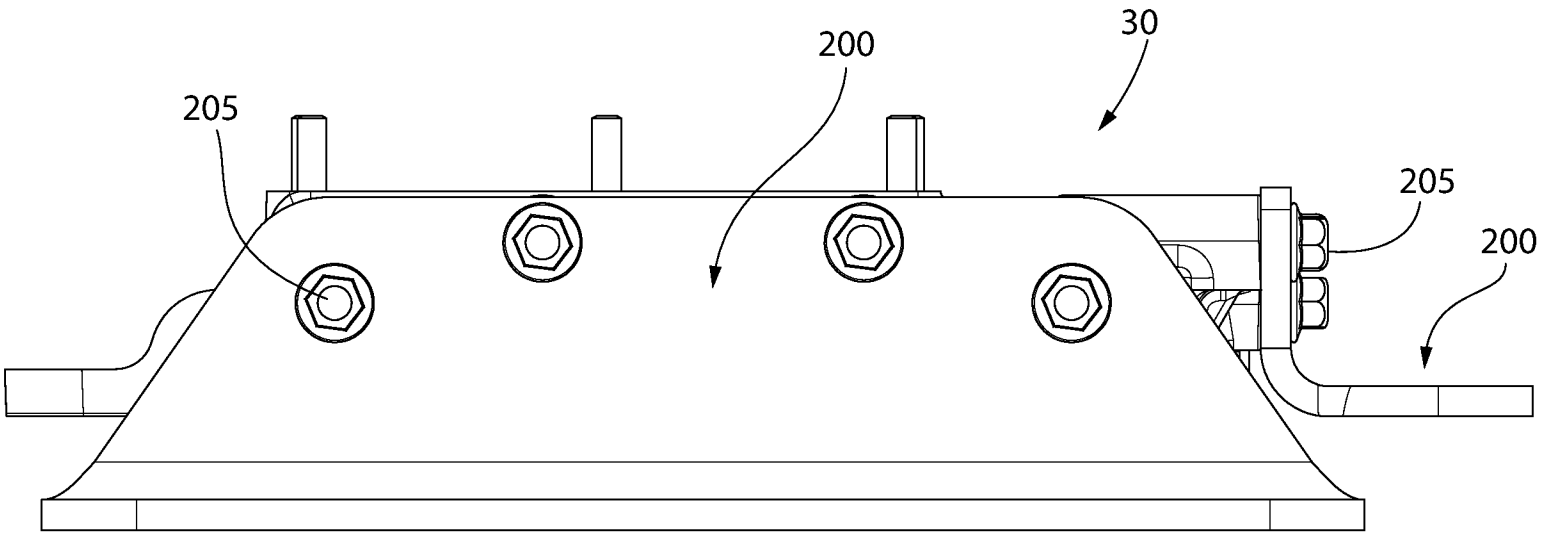
FIG. 39 is a third side view thereof.
Figure 40:
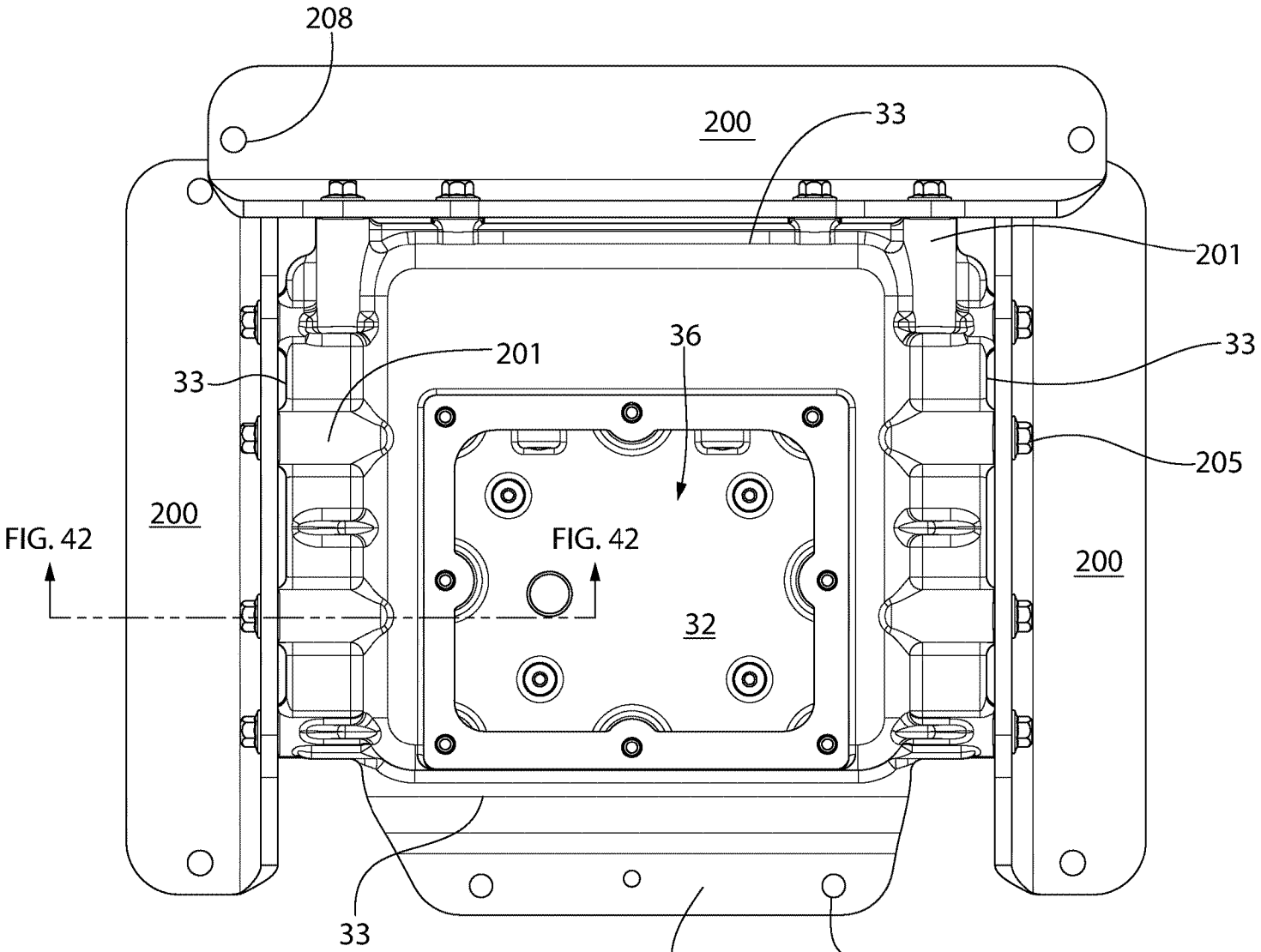
FIG. 40 is a top plan view thereof.
Figure 41:
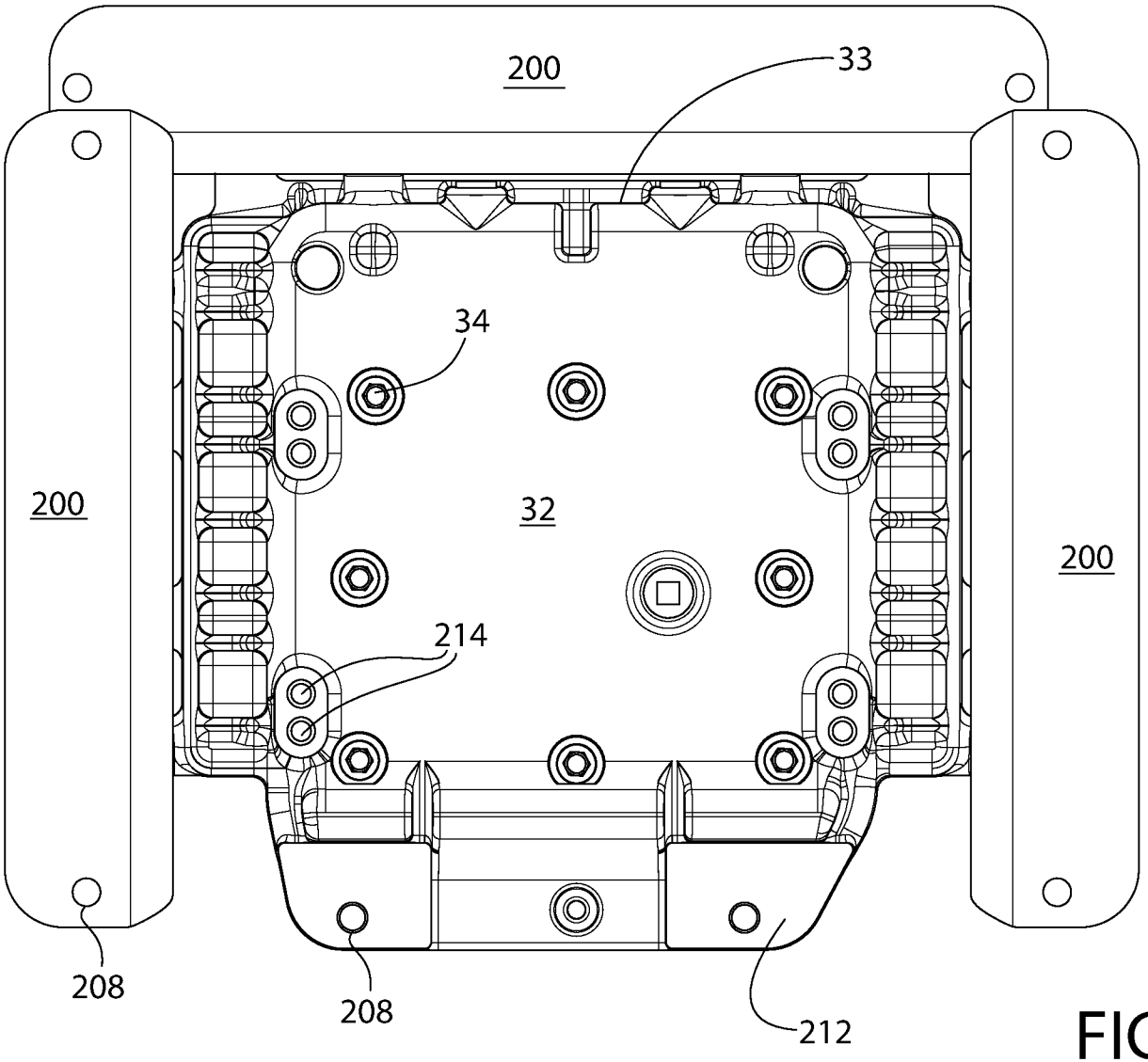
FIG. 41 is a bottom plan view thereof.
Figure 42:
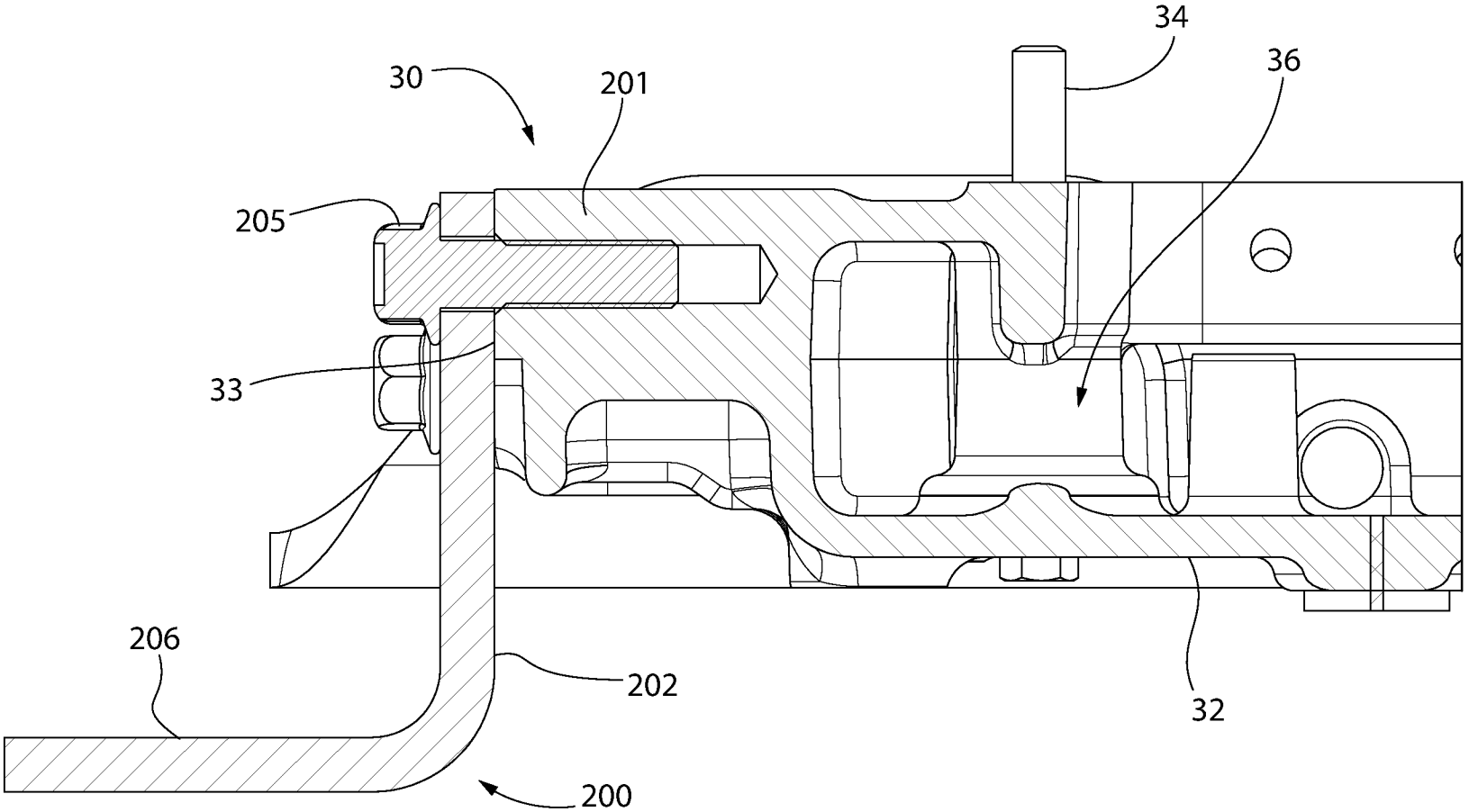
FIG. 42 is a partial side cross-sectional view thereof.

In one configuration, mounting flanges 200 may have a 90 degree L-shaped or angled structure including an upright or vertical flange section 202 configured to coupling to the oil pan 30, and a horizontal flange section 206 configured for coupling to the vehicle chassis 203 (represented schematically by dashed lines in FIG. 37). The vertical flange section may therefore be perpendicular to the horizontal flange section. Vertical flange section 202 includes a first set of oil pan mounting holes 207 arranged in a bolt pattern to match the locations of the threaded bores 204 of mounting bosses 201. Holes 207 become concentrically aligned with the threaded bores 204 of bosses 201 when the mounting flange 200 is placed against the mounting bosses on sidewalls 33 of oil pan 30 to receive mounting bolts 205 therethrough to detachably couple the flanges to the pan.

Horizontal flange section 206 also includes a second set of engine mounting holes 208 arranged in a bolt pattern to match the locations and bolt pattern of corresponding chassis mounting holes 209 on the engine mount portion of the vehicle chassis 203. Threaded fasteners such as engine mounting bolts 210 are received through the concentrically aligned holes 208, 209 to detachably coupled the flange 200 to the chassis (see, e.g. FIG. 37). The bolt pattern of engine mounting holes 208 on engine mounting flange 200 may be customized in location and bolt pattern to match a variety of bolt patterns on different vehicle chassis 203. Accordingly, a plurality of different mounting flanges 200 may be provided each having a different bolt pattern of engine mounting holes 208. Advantageously, a single oil pan 30 may be configurable for mounting to many different brands, models, or styles of vehicle chassis via the modular interchangeable engine mounting flange system.

A set of mounting flanges 200 when coupled to oil pan 30 may each have the same or different overall flange configuration (e.g. size and shape) and same or different bolt patterns for the flange to oil pan coupling and flange to vehicle chassis 203 coupling. This flexibility allows the mounting flanges to be highly customized to meet the engine mounting needs and restrictions of different engines and vehicle chassis. Accordingly, a prefabricated first set of mounting flanges may be provided having engine mounting holes 208 arranged in a first bolt pattern to match the locations and bolt pattern of corresponding chassis mounting holes 209 on the engine mount portion of a first vehicle chassis 203, and a prefabricated second set of mounting flanges may be provided having engine mounting holes 208 arranged in a second bolt pattern to match the locations and bolt pattern of corresponding chassis mounting holes 209 on the engine mount portion of a second vehicle chassis 203; the first bolt pattern being different than the second bolt pattern.

In some instances, one sidewall 33 of oil pan 30 may have an integral engine mounting flange 212 formed as a unitary structural part of the pan. This may be provided where clearance on one side of the oil pan might be limited to detachably mount removable flanges 200 due to interference from engine appurtenances such as a blower housing 213 shown in FIG. 1 or another component. However, in other instances, all sidewalls may have a detachable engine mounting bracket 200 if sufficient clearance is available.

Oil pan 30 may also include integrally formed threaded engine mounting holes 214 arranged in a bolt pattern on the bottom wall 32 of the pan. These mounting holes are located inboard of the mounting bosses 201 and sidewalls of the oil pan and may be used for mounting some engines to the vehicle chassis where a smaller engine mount bolt pattern is provided on the vehicle chassis 203 than cannot be readily accommodated by the perimetrically and peripherally arranged detachable mounting flanges 200. To accommodate variations in bolt patterns used on the chassis, integral engine mounting holes 214 may be provided in pairs to allow the vehicle manufacturer to use one of the holes in each pair for coupling the oil pan 30 and in turn engine 20 to the chassis. Accordingly, the integral engine mounting holes may accommodate at least two different chassis bolt patterns.

A method for mounting an engine to a vehicle chassis using the foregoing modular engine mounting system may comprise: providing an oil pan 30 and plurality of different engine mounting flanges 200 including at least one first mounting flange and at least one second mounting flange, the first mounting flange having first engine mounting holes arranged in a first bolt pattern which is different than a second bolt pattern of second engine mounting holes in the second mounting flange; selecting the first mounting flange; detachably coupling the first mounting flange to a sidewall 33 of the oil pan 30; and bolting the first mounting flange to a vehicle chassis 203. In one implementation, the detachably coupling step may include threadably coupling the first mounting flanges to the sidewalls via threaded fasteners such as bolts. The first and second mounting flanges each have oil pan mounting holes arranged in an identical bolt pattern since all mounting bosses 201 on the oil pan may be arranged to provide a common standard flange mounting interface on the oil pan. Only the bolt pattern of the engine mounting holes on the mounting flanges 200 need to be varied to interface with different bolting patterns on different vehicle chassis.

While the foregoing description and drawings represent examples of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed examples are therefore to be considered in all respects as illustrative and not restrictive, the scope of the invention being defined by the appended claims and equivalents thereof, and not limited to the foregoing description or examples. Rather, the appended claims should be construed broadly, to include other variants of the invention, which may be made by those skilled in the art without departing from the scope and range of equivalents of the invention.

What is claimed is:

1. An engine oil flow control system comprising: an oil sump; a flow control baffle disposed in the oil sump, the baffle including an internal cavity and a plurality of oil inlet openings leading into the cavity; a peripheral oil collection region formed in the sump and extending perimetrically around the baffle; an oil pump intake nozzle disposed at least partially in the cavity and fluidly coupled to an oil pump; wherein a return oil flow path is established between the oil collection region and the cavity via the oil inlet openings; wherein the baffle comprises a hood-shaped body including a top wall and a plurality of sidewalls extending downwards from the top wall; wherein the oil inlet openings are formed in the sidewalls such that the oil flow path is in a lateral direction; and wherein the top wall has no openings through which oil can flow into the cavity.

2. An engine oil flow control system comprising: an oil sump; a flow control baffle disposed in the oil sump, the baffle including an internal cavity and a plurality of oil inlet openings leading into the cavity; a peripheral oil collection region formed in the sump and extending perimetrically around the baffle; an oil pump intake nozzle disposed at least partially in the cavity and fluidly coupled to an oil pump; wherein a return oil flow path is established between the oil collection region and the cavity via the oil inlet openings; wherein the baffle comprises a hood-shaped body including a top wall and a plurality of sidewalls extending downwards from the top wall; wherein the oil pump intake nozzle is integrally formed with the body of the baffle as a unitary structural part thereof; wherein the integral intake nozzle comprises a cantilevered outlet portion coupled to an oil inlet port formed in a crankcase of engine which is fluidly coupled to the oil pump; and wherein the baffle further comprises a cantilevered retention arm arranged to engage a retention surface in the crankcase which prevents the intake nozzle from being axially withdrawn from the oil inlet port.

3. The system according to claim 1, wherein the baffle further comprises an intake nozzle opening receiving the oil pump intake nozzle therethrough.

4. The system according to claim 3, wherein the intake nozzle opening comprises an annular flange extending inwards into the cavity of the baffle.

5. The system according to claim 1, wherein the oil sump is defined by an oil pan detachably coupled to a crankcase of the engine.

6. The system according to 5, further comprising a plurality of vent holes extending through a downwardly extending portion of a mounting flange of the oil pan, the vent holes configured to establish fluid communication between the peripheral region of the oil sump and the crankcase.

7. The system according to claim 1, wherein the oil sump is formed by a lower portion of a crankcase of the engine.

8. The system according to claim 1, wherein the baffle is detachably coupled to a bottom wall of the oil sump.

9. The system according to claim 1, wherein the oil pump intake nozzle is integrally formed with the body of the baffle as a unitary structural part thereof.

10. The system according to claim 9, wherein the integral intake nozzle comprises a cantilevered outlet portion coupled to an oil inlet port formed in a crankcase of engine which is fluidly coupled to the oil pump.

11. The system according to claim 9, wherein the baffle further comprises a cantilevered retention arm arranged to engage a retention surface in the crankcase which prevents the intake nozzle from being axially withdrawn from the oil inlet port.

12. The system according to claim 11, wherein the retention surface is defined by a bottom edge of an oil pump cover.

13. The system according to claim 9, wherein the crankcase includes a pair of horizontally-extending retention protrusions which retain the baffle in the oil sump.

14. The system according to claim 1, wherein the baffle further comprises a labyrinth disposed in the cavity of the baffle, the labyrinth configured to create a circuitous return oil flow path from the oil inlet openings to the oil pump intake nozzle.

15. The system according to claim 14, wherein the labyrinth comprises a plurality of flow diversion walls arranged in different angular orientations with respect to each other to establish the circuitous return oil flow path.

16. An oil flow control baffle for a lubrication system of an engine, the baffle comprising: a hood-shaped body comprising a top wall and plurality of sidewalls defining an internal cavity, the body configured for detachable mounting to an oil sump of the engine; a plurality of oil inlet openings formed through the sidewalls into the cavity; wherein a lateral return oil flow path is established through the sidewalls via the oil inlet openings between regions of the oil sump outside the baffle and the internal cavity; and wherein the top wall has no openings through which oil can flow into the cavity.

17. A method for mounting a flow control baffle in an oil sump of an engine, the method comprising: providing the baffle which comprises a hood-shaped body including an internal cavity and plurality of oil inlet openings in fluid communication with the cavity; coupling an oil intake nozzle at a first end of the baffle to an oil inlet port in a crankcase closure plate, the baffle supported by the crankcase closure plate; positioning the crankcase closure plate against a crankcase of the engine while simultaneously inserting the baffle into an oil sump of the crankcase; and securing the crankcase closure plate onto the crankcase which closes the oil sump; wherein a top wall of the baffle has no openings through which oil can flow into the cavity; and wherein the coupling step includes positioning a retention arm of the baffle in an entrapment pocket of the closure plate.

18. The method according to claim 17, further comprising slideably inserting a second end of the baffle beneath at least one retention protrusion in the oil sump of the crankcase during the step of positioning the crankcase closure plate against the crankcase.

19. The method according to claim 17, further comprising attaching an oil pump cover plate to crankcase closure plate to at least partially cover the entrapment pocket after positioning the retention arm in the entrapment pocket.

20. The method according to claim 19, wherein the retention arm includes an upstanding tab which is trapped inside the entrapment pocket by the cover plate.

21. The method according to claim 17, wherein the baffle is supported in as a cantilevered structure from the crankcase closure plate.

22. An engine oil flow control system comprising: an oil sump; a flow control baffle disposed in the oil sump, the baffle including an internal cavity and a plurality of oil inlet openings leading into the cavity; a peripheral oil collection region formed in the sump and extending perimetrically around the baffle; an oil pump intake nozzle disposed at least partially in the cavity and fluidly coupled to an oil pump; a plurality of vent holes extending through a downwardly extending portion of a mounting flange of the oil pan, the vent holes configured to establish fluid communication between the peripheral region of the oil sump and the crankcase; wherein a return oil flow path is established between the oil collection region and the cavity via the oil inlet openings; wherein the baffle comprises a hood-shaped body including a top wall and a plurality of sidewalls extending downwards from the top wall; wherein the oil inlet openings are formed in the sidewalls such that the oil flow path is in a lateral direction; wherein the baffle further comprises an intake nozzle opening receiving the oil pump intake nozzle therethrough; and wherein the intake nozzle opening comprises an annular flange extending inwards into the cavity of the baffle.

23. An engine oil flow control system comprising: an oil sumo; a flow control baffle disposed in the oil sump, the baffle including an internal cavity and a plurality of oil inlet openings leading into the cavity; a peripheral oil collection region formed in the sump and extending perimetrically around the baffle; an oil pump intake nozzle disposed at least partially in the cavity and fluidly coupled to an oil pump; wherein a return oil flow path is established between the oil collection region and the cavity via the oil inlet openings; wherein the baffle comprises a hood-shaped body including a top wall and a plurality of sidewalls extending downwards from the top wall; wherein the oil inlet openings are formed in the sidewalls such that the oil flow path is in a lateral direction; wherein the intake nozzle opening comprises an annular flange extending inwards into the cavity of the baffle; and wherein the baffle further comprises a labyrinth disposed in the cavity of the baffle, the labyrinth configured to create a circuitous return oil flow path from the oil inlet openings to the oil pump intake nozzle.

* * * * *